US009626974B2

(12) United States Patent
Thiergart et al.

(10) Patent No.: US 9,626,974 B2
(45) Date of Patent: Apr. 18, 2017

(54) SPATIAL AUDIO PROCESSOR AND A METHOD FOR PROVIDING SPATIAL PARAMETERS BASED ON AN ACOUSTIC INPUT SIGNAL

(71) Applicant: Fraunhofer-Gesellschaft zur Foerderung der angewandten Forschung e.V., Munich (DE)

(72) Inventors: Oliver Thiergart, Forchheim (DE); Fabian Kuech, Erlangen (DE); Richard Schultz-Amling, Nuremberg (DE); Markus Kallinger, Erlangen (DE); Giovanni Del Galdo, Martinroda (DE); Achim Kuntz, Hemhofen (DE); Dirk Mahne, Nuremberg (DE); Ville Pulkki, Espoo (FI); Mikko-Ville Laitinen, Espoo (FI)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 653 days.

(21) Appl. No.: 13/629,192

(22) Filed: Sep. 27, 2012

(65) Prior Publication Data

US 2013/0022206 A1 Jan. 24, 2013

Related U.S. Application Data

(63) Continuation of application No. PCT/EP2011/053958, filed on Mar. 16, 2011.
(Continued)

(30) Foreign Application Priority Data

Oct. 7, 2010 (EP) ..... 10186808

(51) Int. Cl.
*H04R 5/00* (2006.01)
*G10L 19/008* (2013.01)
*H04R 29/00* (2006.01)

(52) U.S. Cl.
CPC ..... *G10L 19/008* (2013.01)

(58) Field of Classification Search
CPC ..... G10L 19/008; G10L 2021/02166; H04S 7/30; H04S 2400/15; H04S 2400/11;
(Continued)

(56) References Cited

U.S. PATENT DOCUMENTS 7,542,896 B2 6/2009 Schuijers et al.
2003/0120485 A1 6/2003 Murase et al.
(Continued)

FOREIGN PATENT DOCUMENTS

CN 101673549 3/2010
EP 2146344 A1 1/2010
(Continued)

OTHER PUBLICATIONS

Faller, Christof , "Microphone Front-Ends for Spatial Audio Coders", Proceedings of the AES 125th International Convention, San Francisco, Oct. 2, 2008, 10 pages.
(Continued)

*Primary Examiner* — Paul S Kim
*Assistant Examiner* — Norman Yu
(74) *Attorney, Agent, or Firm* — Michael A. Glenn; Perkins Coie LLP

(57) ABSTRACT

A spatial audio processor for providing spatial parameters based on an acoustic input signal has a signal characteristics determiner and a controllable parameter estimator. The signal characteristics determiner is configured to determine a signal characteristic of the acoustic input signal. The controllable parameter estimator for calculating the spatial
(Continued)

parameters for the acoustic input signal in accordance with a variable spatial parameter calculation rule is configured to modify the variable spatial parameter calculation rule in accordance with the determined signal characteristic.

28 Claims, 11 Drawing Sheets

Related U.S. Application Data

(60) Provisional application No. 61/318,689, filed on Mar. 29, 2010.

(58) Field of Classification Search
CPC ..... H04S 7/302; H04S 7/303; H04S 2400/01; H04S 3/00; H04R 3/005; H04R 5/04; H04R 5/027; H04R 1/406; H04R 5/02; H04R 2201/401; H04R 2203/12
USPC ..... 381/1, 17, 92, 122, 58, 80, 91, 27, 356, 381/56
See application file for complete search history.

(56) References Cited

U.S. PATENT DOCUMENTS

| | | | | |
|---|---|---|---|---|
| 2008/0232601 | A1* | 9/2008 | Pulkki | 381/1 |
| 2008/0298597 | A1* | 12/2008 | Turku et al. | 381/27 |
| 2009/0112607 | A1 | 4/2009 | Ashley et al. | |

FOREIGN PATENT DOCUMENTS

| | | | |
|---|---|---|---|
| EP | 2154910 | | 2/2010 |
| JP | 2003195882 | A | 7/2003 |
| JP | 2005533271 | | 11/2005 |
| JP | 2007178684 | A | 7/2007 |
| RU | 2383941 | C2 | 3/2010 |
| WO | 2009084918 | A1 | 7/2009 |
| WO | 2009116280 | A1 | 9/2009 |
| WO | 2009141775 | A1 | 11/2009 |

OTHER PUBLICATIONS

Kallinger, Markus et al., "A Spatial Filtering Approach for Directional Audio Coding", 126th AES Convention. Munich, Germany., May 7, 2009, 10 Pages.

Molla, Stephane et al., "Determining Local Transientness of Audio Signals", IEEE Signal Processing Letters. vol. 11, No. 7, Jul. 2004, 625-628.

Pulkki, Ville , "Spatial Sound Reproduction with Directional Audio Coding", Journal of the AES. vol. 55, No. 6., Jun. 2007, 503-516.

Schultz-Amling, Richard et al., "Planar Microphone Array Processing for the Analysis and Reproduction of Spatial Audio using Directional Audio Coding", 124th AES Convention. Amsterdam, The Netherlands, May 17, 2008, 10 Pages.

Thiergart, Oliver et al., "Localization of Sound Sources in Reverberat Environments Based on Directional Audio Coding Parameters", 127th AES Convention. New York, NY, USA., Oct. 9, 2009, 14 Pages.

* cited by examiner

SPATIAL AUDIO PROCESSOR AND A METHOD FOR PROVIDING SPATIAL PARAMETERS BASED ON AN ACOUSTIC INPUT SIGNAL

CROSS-REFERENCE TO RELATED APPLICATIONS

This application is a continuation of copending International Patent Application No. PCT/EP2011/053958, filed Mar. 16, 2011, which is incorporated herein by reference in its entirety, and additionally claims priority from European Patent Application No. EP 10186808.1, filed Oct. 7, 2010 and U.S. Patent Application No. 61/318,689, filed Mar. 29, 2010, all of which are incorporated herein by reference in their entirety.

BACKGROUND OF THE INVENTION

Embodiments of the present invention create a spatial audio processor for providing spatial parameters based on an acoustic input signal. Further embodiments of the present invention create a method for providing spatial parameters based on an acoustic input signal. Embodiments of the present invention may relate to the field of acoustic analysis, parametric description, and reproduction of spatial sound, for example based on microphone recordings.

Spatial sound recording aims at capturing a sound field with multiple microphones such that at the reproduction side, a listener perceives the sound image as it was present at the recording location. Standard approaches for spatial sound recording use simple stereo microphones or more sophisticated combinations of directional microphones, e.g., such as the B-format microphones used in Ambisonics. Commonly, these methods are referred to as coincident-microphone techniques.

Alternatively, methods based on a parametric representation of sound fields can be applied, which are referred to as parametric spatial audio processors. Recently, several techniques for the analysis, parametric description, and reproduction of spatial audio have been proposed. Each system has unique advantages and disadvantages with respect to the type of the parametric description, the type of the needed input signals, the dependence and independence from a specific loudspeaker setup, etc.

An example for an efficient parametric description of spatial sound is given by Directional Audio Coding (DirAC) (V. Pulkki: Spatial Sound Reproduction with Directional Audio Coding, Journal of the AES, Vol. 55, No. 6, 2007). DirAC represents an approach to the acoustic analysis and parametric description of spatial sound (DirAC analysis), as well as to its reproduction (DirAC synthesis). The DirAC analysis takes multiple microphone signals as input. The description of spatial sound is provided for a number of frequency subbands in terms of one or several downmix audio signals and parametric side information containing direction of the sound and diffuseness. The latter parameter describes how diffuse the recorded sound field is. Moreover, diffuseness can be used as a reliability measure for the direction estimate. Another application consists of direction-dependent processing of the spatial audio signal (M. Kallinger et al.: A Spatial Filtering Approach for Directional Audio Coding, 126th AES Convention, Munich, May 2009). On the basis of the parametric representation, spatial audio can be reproduced with arbitrary loudspeaker setups. Moreover, the DirAC analysis can be regarded as an acoustic front-end for parametric coding system that are capable of coding, transmitting, and reproducing multi-channel spatial audio, for instance MPEG Surround.

Another approach to the spatial sound field analysis is represented by the so-called Spatial Audio Microphone (SAM) (C. Faller: Microphone Front-Ends for Spatial Audio Coders, in Proceedings of the AES 125th International Convention, San Francisco, October 2008). SAM takes the signals of coincident directional microphones as input. Similar to DirAC, SAM determines the DOA (DOA—direction of arrival) of the sound for a parametric description of the sound field, together with an estimate of the diffuse sound components.

Parametric techniques for the recording and analysis of spatial audio, such as DirAC and SAM, rely on estimates of specific sound field parameters. The performance of these approaches are, thus, strongly dependant on the estimation performance of the spatial cue parameters such as the direction-of-arrival of the sound or the diffuseness of the sound field.

Generally, when estimating spatial cue parameters, specific assumptions on the acoustic input signals can be made (e.g. on the stationarity or on the tonality) in order to employ the best (i.e. the most efficient or most accurate) algorithm for the audio processing. Traditionally, a single time-invariant signal model can be defined for this purpose. However, a problem that commonly arises is that different audio signals can exhibit a significant temporal variance such that a general time-invariant model describing the audio input is often inadequate. In particular, when considering a single time-invariant signal model for processing audio, model mismatches can occur which degrade the performance of the applied algorithm.

SUMMARY

According to an embodiment, a spatial audio processor for providing spatial parameters based on an acoustic input signal may have a signal characteristics determiner configured to determine a signal characteristic of the acoustic input signal, wherein the acoustic input signal comprises at least one directional component; and a controllable parameter estimator for calculating the spatial parameters for the acoustic input signal in accordance with a variable spatial parameter calculation rule; wherein the controllable parameter estimator is configured to modify the variable spatial parameter calculation rule in accordance with the determined signal characteristic.

According to another embodiment, a method for providing spatial parameters based on an acoustic input signal may have the steps of determining a signal characteristic of the acoustic input signal, wherein the acoustic input signal comprises at least one directional component; modifying a variable spatial parameter calculation rule in accordance with the determined signal characteristic; and calculating spatial parameters of the acoustic input signal in accordance with the variable spatial parameter calculation rule.

According to another embodiment, a computer program may have a program code for performing, when running on a computer, the method for providing spatial parameters based on an acoustic input signal, wherein the method may have the steps of determining a signal characteristic of the acoustic input signal, wherein the acoustic input signal comprises at least one directional component; modifying a variable spatial parameter calculation rule in accordance with the determined signal characteristic; and calculating spatial parameters of the acoustic input signal in accordance with the variable spatial parameter calculation rule.

According to another embodiment, a spatial audio processor for providing spatial parameters based on an acoustic input signal, the spatial audio processor may have a signal characteristics determiner configured to determine a signal characteristic of the acoustic input signal; and a controllable parameter estimator for calculating the spatial parameters for the acoustic input signal in accordance with a variable spatial parameter calculation rule; wherein the controllable parameter estimator is configured to modify the variable spatial parameter calculation rule in accordance with the determined signal characteristic; wherein the signal characteristics determiner is configured to determine a stationarity interval of the acoustic input signal and the controllable parameter estimator is configured to modify the variable spatial parameter calculation rule in accordance with the determined stationarity interval, so that an averaging period for calculating the spatial parameters is comparatively longer for a comparatively longer stationarity interval and is comparatively shorter for a comparatively shorter stationarity interval; or wherein the controllable parameter estimator is configured to select one spatial parameter calculation rule out of a plurality of spatial parameter calculation rules for calculating the spatial parameters, in dependence on the determined signal characteristic.

According to another embodiment, a method for providing spatial parameters based on an acoustic input signal may have the steps of determining a signal characteristic of the acoustic input signal; modifying a variable spatial parameter calculation rule in accordance with the determined signal characteristic; calculating spatial parameters of the acoustic input signal in accordance with the variable spatial parameter calculation rule; and determining a stationarity interval of the acoustic input signal and modifying the variable spatial parameter calculation rule in accordance with the determined stationarity interval, so that an averaging period for calculating the spatial parameters is comparatively longer for a comparatively longer stationarity interval and is comparatively shorter for a comparatively shorter stationarity interval; or selecting one spatial parameter calculation rule out of a plurality of spatial parameter calculation rules for calculating the spatial parameters in dependence on the determined signal characteristic.

Embodiments of the present invention create a spatial audio processor for providing spatial parameters based on an acoustic input signal. The spatial audio processor comprises a signal characteristics determiner and a controllable parameter estimator. The signal characteristics determiner is configured to determine a signal characteristic of the acoustic input signal. The controllable parameter estimator is configured to calculate the spatial parameters for the acoustic input signal in accordance with a variable spatial parameter calculation rule. The parameter estimator is further configured to modify the variable spatial parameter calculation rule in accordance with the determined signal characteristic.

It is an idea of embodiments of the present invention that a spatial audio processor for providing spatial parameters based on an acoustic input signal, which reduces model mismatches caused by a temporal variance of the acoustic input signal, can be created when a calculation rule for calculating the spatial parameter is modified based on a signal characteristic of the acoustic input signal. It has been found that model mismatches can be reduced when a signal characteristic of the acoustic input signal is determined, and based on this determined signal characteristic the spatial parameters for the acoustic input signal are calculated.

In other words, embodiments of the present invention may handle the problem of model mismatches caused by a temporal variance of the acoustic input signal by determining characteristics (signal characteristics) of the acoustic input signals, for example in a preprocessing step (in the signal characteristic determiner) and then identifying the signal model (for example a spatial parameter calculation rule or parameters of the spatial parameter calculation rule) which best fits the current situation (the current signal characteristics). This information can be fed to the parameter estimator which can then select the best parameter estimation strategy (in regard to the temporal variance of the acoustic input signal) for calculating the spatial parameters. It is therefore an advantage of embodiments of the present invention that a parametric field description (the spatial parameters) with a significantly reduced model mismatch can be achieved.

The acoustic input signal may for example be a signal measured with one or more microphone(s), e.g. with microphone arrays or with a B-format microphone. Different microphones may have different directivities. Acoustic input signals can be, for instance, a sound pressure "P" or a particular velocity "U", for example in a time or in frequency domain (e.g. in a STFT-domain, STFT=short time Fourier transform) or in other words either in a time representation or in a frequency representation. The acoustic input signal may for example comprise components in three different (for example orthogonal) directions (for example an x-component, a y-component and a z-component) and of an omnidirectional component (for example a w-component). Furthermore, the acoustic input signals may only contain components of the three directions and no omnidirectional component. Furthermore, the acoustic input signal may only comprise the omnidirectional component. Furthermore, the acoustic input signal may comprise two directional components (for example the x-component and the y-component, the x-component and the z-component or the y-component and the z-component) and the omnidirectional component or no omnidirectional component. Furthermore, the acoustic input signal may comprise only one directional component (for example the x-component, the y-component or the z-component) and the omnidirectional component or no omnidirectional component.

The signal characteristic determined by the signal characteristics determiner from the acoustic input signal, for example from microphone signals, can be for instance: stationarity intervals with respect to time, frequency, space; presence of double talk or multiple sounds sources; presence of tonality or transients; a signal-to-noise ratio of the acoustic input signal; or presence of applause-like signals.

Applause-like signals are herein defined as signals, which comprise a fast temporal sequence of transients, for example, with different directions.

The information gathered by the signal characteristic determiner can be used to control the controllable parameter estimator, for example in directional audio coding (DirAC) or spatial audio microphone (SAM), for instance to select the estimator strategy or the estimator settings (or in other words to, modify the variable spatial parameter calculation rule) which fits best the current situation (the current signal characteristic of the acoustic input signal).

Embodiments of the present invention can be applied in a similar way to both systems, spatial audio microphone (SAM) and directional audio coding (DirAC), or to any other parametric system. In the following, a main focus will lie on the directional audio coding analysis.

According to some embodiments of the present invention the controllable parameter estimator may be configured to calculate the spatial parameters as directional audio coding parameters comprising a diffuseness parameter for a time slot and a frequency subband and/or a direction of arrival parameter for a time slot and a frequency subband or as spatial audio microphone parameters.

In the following, direction audio coding and spatial audio microphone are considered as acoustic front ends for systems that operate on spatial parameters, such as for example the direction of arrival and the diffuseness of sound. It should be noted that it is straightforward to apply the concept of the present invention to other acoustic front ends also. Both directional audio coding and spatial audio microphone provide specific (spatial) parameters obtained from acoustic input signals for describing spatial sound. Traditionally, when processing spatial audio with acoustic front ends such as direction audio coding and special audio microphone, a single general model for the acoustic input signals is defined so that optimal (or nearly optimal) parameter estimators can be derived. The estimators perform as desired as long as the underlying assumptions taken into account by the model are met. As mentioned before, if this is not the case model mismatches arise, which usually leads to severe errors in the estimates. Such model mismatches represent a recurrent problem since acoustic input signals are usually highly time variant.

BRIEF DESCRIPTION OF THE DRAWINGS

Embodiments according to the present invention will be described taking reference to the enclosed figures, in which.

DETAILED DESCRIPTION OF THE INVENTION

Before embodiments of the present invention will be explained in greater detail using the accompanying figures, it is to be pointed out that the same or functionally equal elements are provided with the same reference numbers and that a repeated description of these elements shall be omitted. Descriptions of elements provided with the same reference numbers are therefore mutually interchangeable.

Figure 1:
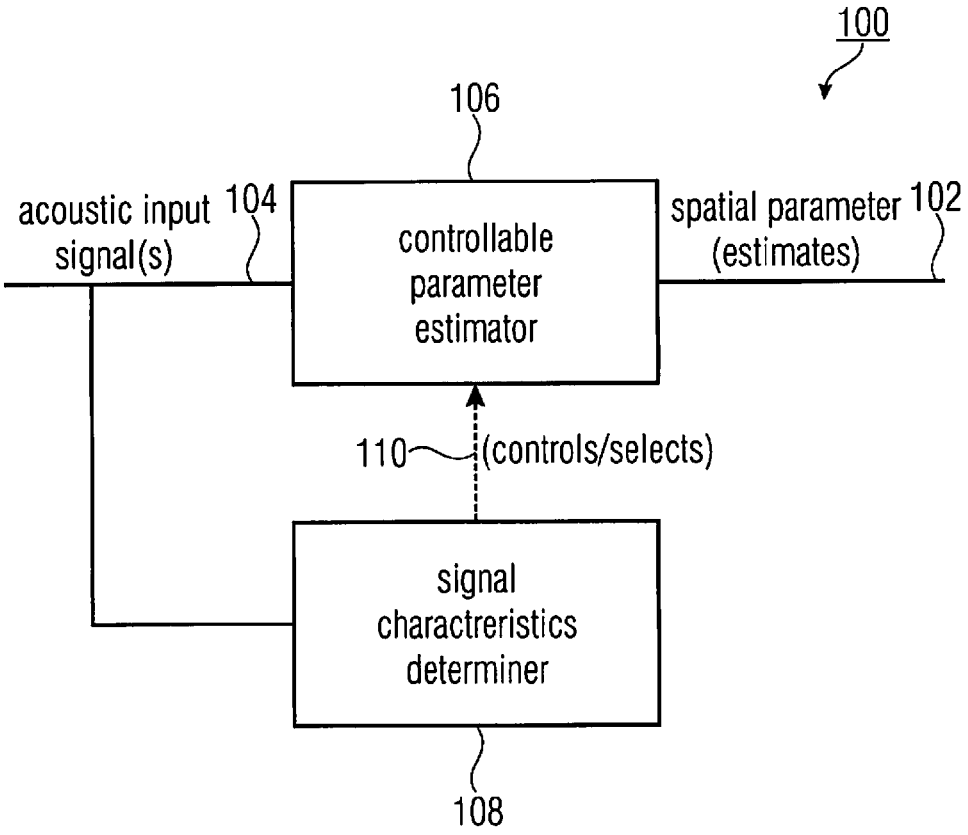
FIG. 1 shows a block schematic diagram of a spatial audio processor according to an embodiment of the present invention.

Spatial Audio Processor According to FIG. 1

In the following a spatial audio processor 100 will be described taking reference to FIG. 1, which shows a block schematic diagram of such a spatial audio processor. The spatial audio processor 100 for providing spatial parameters 102 or spatial parameter estimates 102 based on an acoustic input signal 104 (or on a plurality of acoustic input signals 104) comprises a controllable parameter estimator 106 and a signal characteristics determiner 108. The signal characteristics determiner 108 is configured to determine a signal characteristic 110 of the acoustic input signal 104. The controllable parameter estimator 106 is configured to calculate the spatial parameters 102 for the acoustic input signal 104 in accordance with a variable spatial parameter calculation rule. The controllable parameter estimator 106 is further configured to modify the variable spatial parameter calculation rule in accordance with the determined signal characteristics 110.

In other words, the controllable parameter estimator 106 is controlled depending on the characteristics of the acoustic input signals or the acoustic input signal 104.

The acoustic input signal 104 may, as described before, comprise directional components and/or omnidirectional components. A suitable signal characteristic 110, as already mentioned, can be for instance stationarity intervals with respect to time, frequency, space of the acoustic input signal 104, a presence of double talk or multiple sound sources in the acoustic input signal 104, a presence of tonality or transients inside the acoustic input signal 104, a presence of applause or a signal to noise ratio of the acoustic input signal 104. This enumeration of suitable signal characteristics is just an example of signal characteristics the signal characteristics determiner 108 may determine. According to further embodiments of the present invention the signal characteristics determiner 108 may also determine other (not mentioned) signal characteristics of the acoustic input signal 104 and the controllable parameter estimator 106 may modify the variable spatial parameter calculation rule based on these other signal characteristics of the acoustic input signal 104.

The controllable parameter estimator 106 may be configured to calculate the spatial parameters 102 as directional audio coding parameters comprising a diffuseness parameter $\Psi(k, n)$ for a time slot n and a frequency subband k and/or a direction of arrival parameter $\phi(k, n)$ for a time slot n and a frequency subband k or as spatial audio microphone parameters, for example for a time slot n and a frequency subband k.

The controllable parameter estimator 106 may be further configured to calculate the spatial parameters 102 using another concept than DirAC or SAM. The calculation of DirAC parameters and SAM parameters shall only be understood as examples. The controllable parameter estimator may, for example, be configured to calculate the spatial parameters 102, such that the spatial parameters comprise a direction of the sound, a diffuseness of the sound or a statistical measure of the direction of the sound.

The acoustic input signal 104 may for example be provided in a time domain or a (short time) frequency-domain, e.g. in the STFT-domain.

For example, the acoustic signal 104, where it is provided in the time domain, may comprise a plurality of acoustic audio streams $x_1(t)$ to $x_N(t)$ each comprising a plurality of acoustic input samples over time. Each of the acoustic input streams may for examples be provided from a different microphone and may correspond with a different look direction. For example, a first acoustic input stream $x_1(t)$ may correspond with a first direction (for example with an x-direction), a second acoustic input stream $x_2(t)$ may correspond with a second direction, which may be orthogonal to the first direction (for example a y-direction), a third acoustic input stream $x_3(t)$ may correspond with a third direction, which may be orthogonal to the first direction and to the second direction (for example a z-direction) and a fourth acoustic input stream $x_4(t)$ may be an omnidirectional component. These different acoustic input streams may be recorded from different microphones, for example in an orthogonal orientation and may be digitized using an analog-to-digital converter.

According to further embodiments of the present invention the acoustic input signal 104 may comprise acoustic input streams in a frequency representation, for example in a time frequency domain, such as the STFT-domain. For example, the acoustic input signal 104 may be provided in the B-format comprising a particular velocity vector U(k, n) and a sound pressure vector P(k, n), wherein k denotes a frequency subband and n denotes a time slot. The particular velocity vector U(k, n) is a directional component of the acoustic input signal 104, wherein the sound pressure P(k, n) represents an omnidirectional component of the acoustic input signal 104.

As mentioned before, the controllable parameter estimator 106 may be configured to provide the spatial parameters 102 as directional audio coding parameters or as spatial audio microphone parameters. In the following a conventional directional audio coder will be presented as a reference example. A block schematic diagram of such a conventional directional audio coder is shown in FIG. 2.

Figure 2:
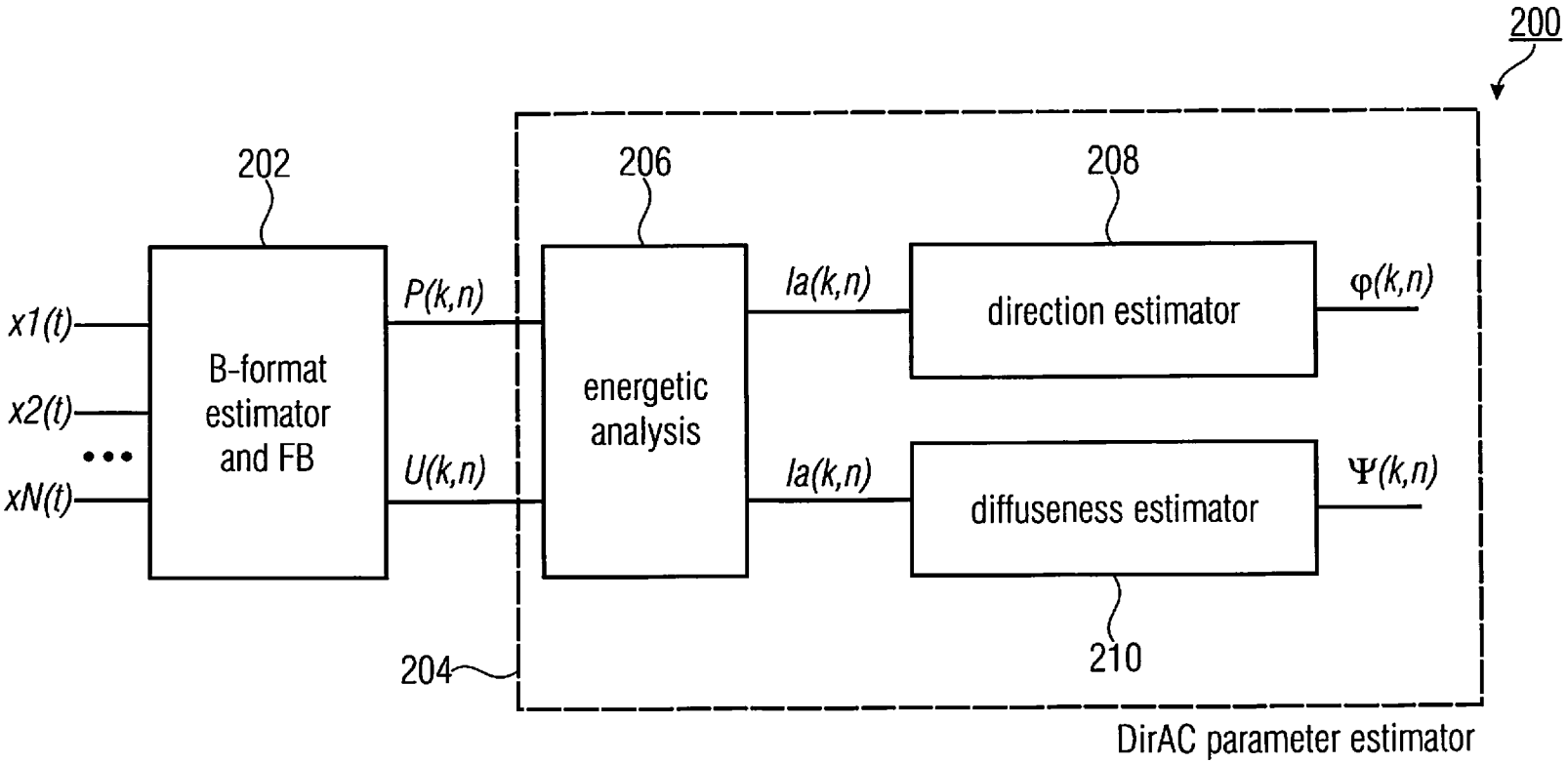
FIG. 2 shows a block schematic diagram of a directional audio coder as a reference example.

Conventional Directional Audio According to FIG. 2

FIG. 2 shows a bock schematic diagram of a directional audio coder 200. The directional audio coder 200 comprises a B-format estimator 202. The B-format estimator 202 comprises a filter bank. The directional audio coder 200 further comprises a directional audio coding parameter estimator 204. The directional audio coding parameter estimator 204 comprises an energetic analyzer 206 for performing an energetic analysis. Furthermore, the directional audio coding parameter estimator 204 comprises a direction estimator 208 and a diffuseness estimator 210.

Directional Audio Coding (DirAC) (V. Pulkki: Spatial Sound Reproduction with Directional Audio Coding, Journal of the AES, Vol. 55, No. 6, 2007) represents an efficient, perceptually motivated approach to the analysis and reproduction of spatial sound. The DirAC analysis provides a parametric description of the sound field in terms of a downmix audio signal and additional side information, e.g. direction of arrival (DOA) of the sound and diffuseness of the sound field. DirAC takes features into account that are relevant for the human hearing. For instance, it assumes that interaural time differences (ITD) and interaural level differences (ILD) can be described by the DOA of the sound. Correspondingly, it is assumed that the interaural coherence (IC) can be represented by the diffuseness of the sound field. From the output of the DirAC analysis, a sound reproduction system can generate features to reproduce the sound with the original spatial impression with an arbitrary set of loudspeakers. It should be noted that diffuseness can also be considered as a reliability measure for the estimated DOAs. The higher the diffuseness, the lower the reliability of the DOA, and vice versa. This information can be used by many DirAC based tools such as source localization (O. Thiergart et al.: Localization of Sound Sources in Reverberant Environments Based on Directional Audio Coding Parameters, 127th AES Convention, NY, October 2009). Embodiments of the present invention focus on the analysis part of DirAC rather than on the sound reproduction.

In the DirAC analysis, the parameters are estimated via an energetic analysis performed by the energetic analyzer 206 of the sound field, based on B-format signals provided by the B-format estimator 202. B-format signals consist of an omnidirectional signal, corresponding to sound pressure P(k, n), and one, two, or three dipole signals aligned with the x-, y-, and z-direction of a Cartesian coordinate system. The dipole signals correspond to the elements of the particle velocity vector U(k, n). The DirAC analysis is depicted in FIG. 2. The microphone signals in time domain, namely $x_1(t), x_2(t), \ldots, x_N(t)$, are provided to the B-format estimator 202. These time domain microphone signals can be referred to as "acoustic input signals in the time domain" in the following. The B-format estimator 202, which contains a short-time Fourier transform (STFT) or another filter bank (FB), computes the B-format signals in the short-time frequency domain, i.e., the sound pressure P(k,n) and the particle velocity vector U(k,n), where k and n denote the frequency index (a frequency subband) and the time block index (a time slot), respectively. The signals P(k,n) and U(k,n) can be referred to as "acoustic input signals in the short-time frequency domain" in the following. The B-format signals can be obtained from measurements with microphone arrays as explained in R. Schultz-Amling et al.: Planar Microphone Array Processing for the Analysis and Reproduction of Spatial Audio using Directional Audio Coding, 124th AES Convention, Amsterdam, The Netherlands, May 2008, or directly by using e.g. a B-format microphone. In the energetic analysis, the active sound intensity vector $I_a(k,n)$ can be estimated separately for different frequency bands using $$I_a(k,n)=Re\{P(k,n)U^*(k,n)\}, \tag{1}$$

where Re(·) yields the real part and U*(k,n) denotes the complex conjugate of the particle velocity vector U(k,n).

In the following, the active sound intensity vector will also be called intensity parameter.

Using the STFT-domain representation in equation 1, the DOA of the sound $\phi(k,n)$ can be determined in the direction estimator 208 for each k and n as the opposite direction of the active sound intensity vector $I_a(k,n)$. In the diffuseness estimator 210, the diffuseness of the sound field $\tilde{\Psi}(k,n)$ can be computed based on fluctuations of the active intensity according to $$\tilde{\Psi}(k, n) = 1 - \frac{|E(I_a(k, n))|}{E(|I_a(k, n)|)}, \tag{2}$$

where |(·)| denotes the vector norm and E(·) returns the expectation. In the practical application, the expectation E(·) can be approximated by a finite averaging along one or more specific dimensions, e.g., along time, frequency, or space.

It has been found that the expectation E(·) in equation 2 can be approximated by averaging along a specific dimension. For this issue the averaging can be carried out along time (temporal averaging), frequency (spectral averaging), or space (spatial averaging). Spatial averaging means for instance that the active sound intensity vector $I_a(k,n)$ in equation 2 is estimated with multiple microphone arrays placed in different points. For instance we can place four different (microphone) arrays in four different points inside the room. As a result we then have for each time frequency point (k,n) four intensity vectors $I_a(k,n)$ which can be averaged (in the same way as e.g. the spectral averaging) to obtain an approximation for the expectation operator $E(\cdot)$.

For instance, when using a temporal averaging over several n, we obtain an estimate $\Psi(k,n)$ for the diffuseness parameter given by $$\Psi(k,n) = 1 - \frac{|\langle I_a(k,n)\rangle_n|}{\langle |I_a(k,n)|\rangle_n}. \tag{3}$$

There exist common methods for realizing a temporal averaging as needed in (3). One Method is block averaging (interval averaging) over a specific number N of time instances n, given by $$\langle y(k,n)\rangle_n = \frac{1}{N}\sum_{m=0}^{N-1} y(k,n-m), \tag{4}$$

where y(k,n) is the quantity to be averaged, e.g., $I_a(k,n)$ or $|I_a(k,n)|$. A second method for computing temporal averages, which is usually used in DirAC due to its efficiency, is to apply infinite impulse response (IIR) filters. For instance, when using a first-order low-pass filter with filter coefficient $\alpha \in [0,1]$, a temporal averaging of a certain signal y(k,n) along n can be obtained with $$\langle y(k,n)\rangle_n \bar{y}(k,n) = \alpha \cdot y(k,n) + (1-\alpha)\cdot \bar{y}(k,n-1) \tag{5}$$

where $\bar{y}(k,n)$ denotes the actual averaging result and $\bar{y}(k,n-1)$ is the past averaging result, i.e., the averaging result for the time instance (n−1). A longer temporal averaging is achieved for smaller α, while a larger α yields more instantaneous results where the past result $\bar{y}(k,n-1)$ counts less. A typical value for α used in DirAC is α=0.1.

It has been found that besides using temporal averaging, the expectation operator in equation 2 can also be approximated by spectral averaging along several or all frequency subbands k. This method is only applicable if no independent diffuseness estimates for the different frequency subbands in the later processing, e.g., when only a single sound source is present, are needed. Hence, usually the most appropriate way to compute the diffuseness in practice may be to employ temporal averaging.

Generally, when approximating an expectation operator as the one in equation 2 by an averaging process, we assume stationarity of the considered signal with respect to the quantity to be averaged. The longer the averaging, i.e., the more samples taken into account, the more accurate the results usually.

In the following, the spatial audio microphone (SAM) analysis shall also be explained in short.

Spatial Audio Microphone (SAM) Analysis

Similar to DirAC, the SAM analysis (C. Faller: Microphone Front-Ends for Spatial Audio Coders, in Proceedings of the AES 125th International Convention, San Francisco, October 2008) provides a parametric description of spatial sound. The sound field representation is based on a downmix audio signal and parametric side information, namely the DOA of the sound and estimates of the levels of direct and diffuse sound components. Input to the SAM analysis are the signals measured with multiple coincident directional microphones, e.g., two cardioid sensors placed in the same point. Basis for the SAM analysis are the power spectral densities (PSDs) and the cross spectral densities (CSDs) of the input signals.

For instance, let $X_1(k,n)$ and $X_2(k,n)$ be the signals in the time-frequency domain measured by two coincident directional microphones. The PSDs of both input signals can be determined with $$\mathrm{PSD}_1(k,n) = E\{X_1(k,n)X^*_1(k,n)\}$$

$$\mathrm{PSD}_2(k,n) = E\{X_2(k,n)X^*_2(k,n)\}. \tag{5a}$$

The CSD between both inputs is given by the correlation $$\mathrm{CSD}(k,n) = E\{X_1(k,n)X^*_2(k,n)\}. \tag{5b}$$

SAM assumes that the measured input signals $X_1(k,n)$ and $X_2(k,n)$ represent a superposition of direct sound and diffuse sound, whereas direct sound and diffuse sound are uncorrelated. Based on this assumption, it is shown in C. Faller: Microphone Front-Ends for Spatial Audio Coders, in Proceedings of the AES 125th International Convention, San Francisco, October 2008, that it is possible to derive from equations 5a and 5b for each sensor the PSD of the measured direct sound and the measured diffuse sound. From the ratio between the direct sound PSDs it is then possible to determine the DOA $\phi(k,n)$ of the sound with a priori knowledge of the microphones' directional responses.

It has been found that in a practical application, the expectations $E\{\cdot\}$ in equation 5a and 5b can be approximated by temporal and/or spectral averaging operations. This is similar to the diffuseness computation in DirAC described in the previous section. Similarly, the averaging can be carried out using e.g. equation 4 or 5. To give an example, the estimation of the CSD can be performed based on recursive temporal averaging according to $$\mathrm{CDS}(k,n) \approx \alpha \cdot X_1(k,n)X^*_2(k,n) + (1-\alpha)\cdot \mathrm{CDS}(k,n-1). \tag{5c}$$

As discussed in the previous section, when approximating an expectation operator as the one in equations 5a and 5b by an averaging process, stationarity of the considered signal with respect to the quantity to be averaged, may have to be assumed.

In the following, an embodiment of the present invention will be explained, which performs a time variant parameter estimation depending on a stationarity interval.

Figure 3:
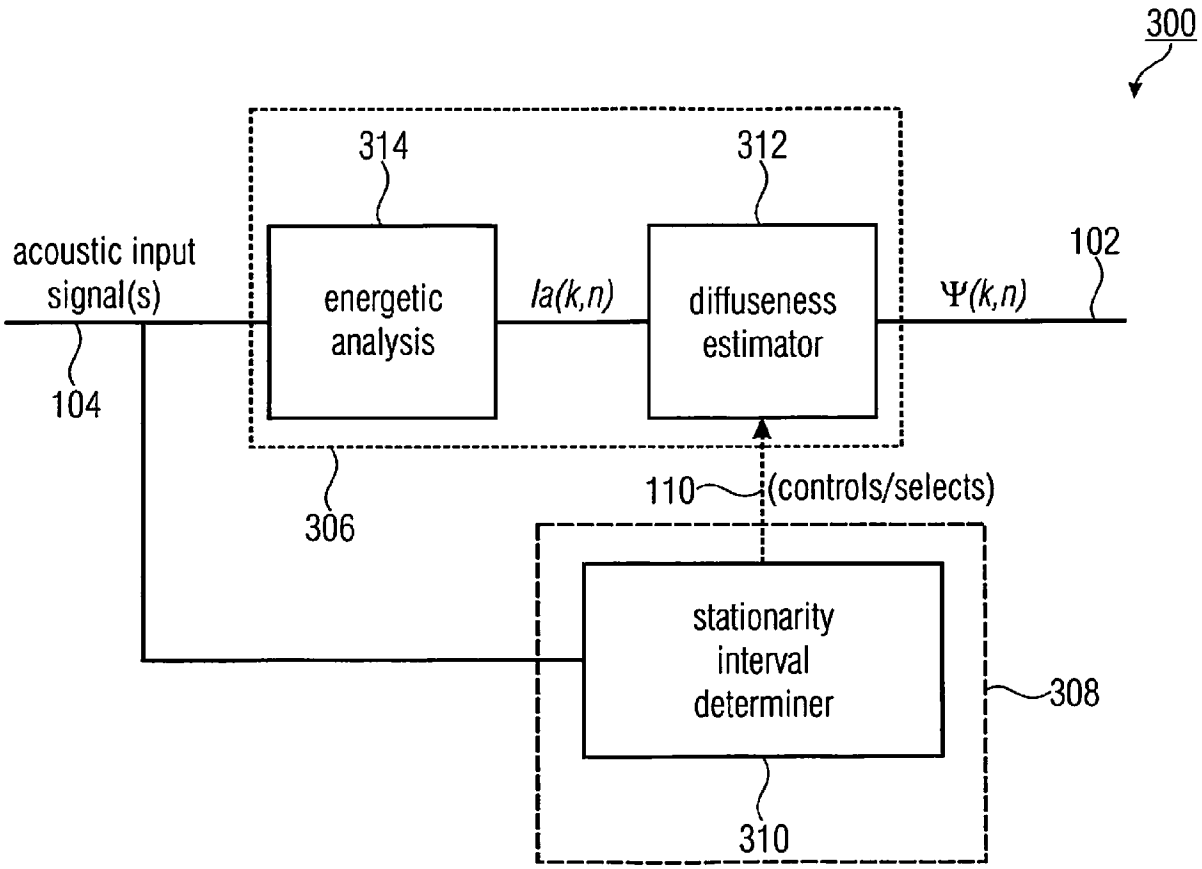
FIG. 3 shows a block schematic diagram of a spatial audio processor according to a further embodiment of the present invention.

Spatial Audio Processor According to FIG. 3

FIG. 3 shows a spatial audio processor 300 according to an embodiment of the present invention. in A functionality of the spatial audio processor 300 may be similar to a functionality of the spatial audio processor 100 according to FIG. 1. The spatial audio processor 300 may comprise the additional features shown in FIG. 3. The spatial audio processor 300 comprises a controllable parameter estimator 306, a functionality of which may be similar to a functionality of the controllable parameter estimator 106 according to FIG. 1 and which may comprise the additional features described in the following. The spatial audio processor 300 further comprises a signal characteristics determiner 308, a functionality of which may be similar to a functionality of the signal characteristics determiner 108 according to FIG. 1 and which may comprise the additional features described in the following.

The signal characteristics determiner 308 may be configured to determine a stationarity interval of the acoustic input signal 104, which constitutes the determined signal characteristic 110, for example using a stationarity interval determiner 310. The parameter estimator 306 may be configured to modify the variable parameter calculation rule in accordance with the determined signal characteristic 110, i.e. the determined stationarity interval. The parameter estimator 306 may be configured to modify the variable parameter calculation rule such that an averaging period or averaging length for calculating the spatial parameters 102 is comparatively longer (higher) for a comparatively longer stationarity interval and is comparatively shorter (lower) for a comparatively shorter stationarity interval. The averaging length may, for example, be equal to the stationarity interval.

In other words the spatial audio processor 300 creates a concept for improving the diffuseness estimation in direction audio coding by considering the varying interval of stationarity of the acoustic input signal 104 or the acoustic input signals.

The stationarity interval of the acoustic input signal 104 may, for example, define a time period in which no (or only an insignificantly small) movement of a sound source of the acoustic input signal 104 occurred. In general, the stationarity of the acoustic input signal 104 may define a time period in which a certain signal characteristic of the acoustic input signal 104 remains constant along time. The signal characteristic may, for example, be a signal energy, a spatial diffuseness, a tonality, a Signal to Noise Ratio and/or others. By taking into account the stationarity interval of the acoustic input signal 104 for calculating the spatial parameters 102 an averaging length for calculating the spatial parameters 102 can be modified such that a precision of the spatial parameters 102 representing the acoustic input signal 104 can be improved. For example, for a longer stationarity interval, which means the sound source of the acoustic input signal 104 has not been moved for a longer interval, a longer temporal (or time) averaging can be applied than for a shorter stationarity interval. Therefore, an at least nearly optimal (or in some cases even an optimal) spatial parameter estimation can be performed by the controllable parameter estimator 306 depending on the stationarity interval of the acoustic input signal 104.

The controllable parameter estimator 306 may for example be configured to provide a diffuseness parameter $\Psi(k, n)$, for example, in a STFT-domain for a frequency subband k and a time slot or time block n. The controllable parameter estimator 306 may comprise a diffuseness estimator 312 for calculating the diffuseness parameter $\Psi(k, n)$, for example based on a temporal averaging of an intensity parameter $I_a(k, n)$ of the acoustic input signal 104 in a STFT-domain. Furthermore, the controllable parameter estimator 306 may comprise an energetic analyzer 314 to perform an energetic analysis of the acoustic input signal 104 to determine the intensity parameter $I_a(k, n)$. The intensity parameter $I_a(k, n)$ may also be designated as active sound intensity vector and may be calculated by the energetic analyzer 314 according to equation 1.

Therefore, the acoustic input signal 104 may also be provided in the STFT-domain for example in the B-formant comprising a sound pressure $P(k, n)$ and a particular velocity vector $U(k, n)$ for a frequency subband k and a time slot n.

The diffuseness estimator 312 may calculate the diffuseness parameter $\Psi(k, n)$ based on a temporal averaging of intensity parameters $I_a(k, n)$ of the acoustic input signal 104, for example, of the same frequency subband k. The diffuseness estimator 312 may calculate the diffuseness parameter $\Psi(k, n)$ according to equation 3, wherein a number of intensity parameters and therefore the averaging length can be varied by the diffuseness estimator 312 in dependence on the determined stationarity interval.

As a numeric example, if a comparatively long stationarity interval is determined by the stationarity interval determiner 310 the diffuseness estimator 312 may perform the temporal averaging of the intensity parameters $I_a(k, n)$ over intensity parameters $I_a(k, n-10)$ to $I_a(k, n-1)$. For a comparatively short stationarity interval determined by the stationarity interval determiner 310 the diffuseness estimator 312 may perform the temporal averaging of the intensity parameters $I_a(k, n)$ for intensity parameters $I_a(k, n-4)$ to $I_a(k, n-1)$.

As can be seen, the averaging length of the temporal averaging applied by the diffuseness estimator 312 corresponds with the number of intensity parameters $I_a(k, n)$ used for the temporal averaging.

In other words, the directional audio coding diffuseness estimation is improved by considering the time invariant stationarity interval (also called coherence time) of the acoustic input signals or the acoustic input signal 104. As explained before, the common way in practice for estimating the diffuseness parameter $\Psi(k, n)$ is to use equation 3, which comprises a temporal averaging of the active intensity vector $I_a(k, n)$. It has been found that the optimal averaging length depends on the temporal stationarity of the acoustic input signals or the acoustic input signal 104. It has been found that the most accurate results can be obtained when the averaging length is chosen to be equal to the stationarity interval.

Traditionally, as shown with the conventional directional audio coder 200, a general time invariant model for the acoustic input signal is defined from which the optimal parameter estimation strategy is then defined, which in this case means the optimal temporal averaging length. For the diffuseness estimation, it is typically assumed that the acoustic input signal possess time stationarity within a certain time interval, for instance 20 ms. In other words, the considered stationarity interval is set to a constant value which is typical for several input signals. From the assumed stationarity interval the optimal temporal averaging strategy is then derived, e.g. the best value for a when using an IIR averaging as shown in equation 5, or the best N when using a block averaging as shown in equation 4.

However, it has been found that different acoustic input signals are usually characterized by different stationarity intervals. Thus, the traditional method of assuming a time invariant model for the acoustic input signal does not hold. In other words, when the input signal exhibits stationarity intervals that are different from the one assumed by the estimator, we may run into a model mismatch which may result in poor parameter estimates.

Therefore, the proposed novel approach (for example realized in the spatial audio processor 300) adapts the parameter estimation strategy (the variable spatial parameter calculation rule) depending on the actual signal characteristic, as visualized in FIG. 3 for the diffuseness estimation: the stationarity interval of the acoustic input signal 104, i.e. of the B-format signal, is determined in a preprocessing step (by the signal characteristics determiner 308). From this information (from the determined stationarity interval) the best (or in some cases the nearly best) temporal averaging length, the best (or in some cases the nearly best) value for a or for N is chosen, and then the (spatial) parameter calculation is carried out with the diffuseness estimator 312.

It should be mentioned that besides a signal adaptive diffuseness estimation in DirAC, it is possible to improve the direction estimation in SAM in a very similar way. In fact, computing the PSDs and the CSDs of the acoustic input signals in equations 5a and 5b also needs to approximate expectation operators by a temporal averaging process (e.g. by using the equations 4 or 5). As explained above, the most accurate results can be obtained when the averaging length corresponds to the stationarity interval of the acoustic input signals. This means that the SAM analysis can be improved by first determining the stationarity interval of the acoustic input signals, and then choosing from this information the best averaging length. The stationarity interval of the acoustic input signals and the corresponding optimal averaging filter can be determined as explained in the following.

In the following an exemplary approach determining the stationarity interval of the acoustic input signal 104 will be presented. From this information the optimal temporal averaging length for the diffuseness computation shown in equation 3 is then chosen.

Stationarity Interval Determination

In the following, a possible way for determining the stationarity interval of an acoustic input signal (for example the acoustic input signal 104) as well as the optimal IIR filter coefficient $\alpha$ (for example used in equation 5), which yields a corresponding temporal averaging is described. The stationarity interval determination described in the following may be performed by the stationarity interval determiner 310 of the signal characteristics determiner 308. The presented method allows to use equation 3 to accurately estimate the diffuseness (parameter) $\Psi(k, n)$ depending on the stationarity interval of the acoustic input signal 104. The frequency domain sound pressure P(k, n), which is part of the B-format signal, can be considered as the acoustic input signal 104. In other words the acoustic input signal 104 may comprise at least one component corresponding to the sound pressure P(k, n).

Acoustic input signals generally exhibit a short stationarity interval if the signal energy varies strongly within a short time interval, and vice versa. Typical examples for which the stationarity interval is short are transients, onsets in speech, and "offsets", namely when a speaker stops talking. The latter case is characterized by strongly decreasing signal energy (negative gain) within a short time, while in the two former cases, the energy strongly increases (positive gain).

The desired algorithm, which aims at finding the optimal filter coefficient $\alpha$, has to provide values near $\alpha=1$ (corresponding to a short temporal averaging) for high non-stationary signals, and values near $\alpha=\alpha'$ in case of stationarity. The symbol $\alpha'$ denotes a suitable signal independent filter coefficient for averaging stationary signals. Expressed in mathematical terms, an adequate algorithm is given by $$\alpha^{+}(k, n) = \frac{\alpha' \cdot W(k, n)}{\alpha' \cdot W(k, n) + (1 - \alpha') \cdot \overline{W}(k, n)}, \tag{7}$$

where $\alpha^{+}(k,n)$ is the optimal filter coefficient for each time-frequency bin, $W(k,n)=|P(k,n)|^2$ is the absolute value of the instantaneous signal energy of P(k,n), and $\overline{W}(k, n)$ is a temporal average of W(k,n). For stationary signals the instantaneous energy W(k,n) equals the temporal average $\overline{W}(k, n)$ which yields $\alpha^{+}=\alpha'$ as desired. In case of highly non-stationary signals due to positive energy gains the denominator of equation 7 becomes near $\alpha' \cdot W(k,n)$, as W(k,n) is large compared to $\overline{W}(k, n)$. Thus, $\alpha^{+}\approx 1$ is obtained as desired. In case of non-stationarity due to negative energy gains the undesired result $\alpha^{+}\approx 0$ is obtained, since $\overline{W}(k, n)$ becomes large compared to W(k,n). Therefore, an alternative candidate for the optimal filter coefficient $\alpha$, namely $$\alpha^{-}(k, n) = \frac{\alpha' \cdot \overline{W}(k, n)}{(1 - \alpha') \cdot W(k, n) + \alpha' \cdot \overline{W}(k, n)}, \tag{8}$$

is introduced, which is similar to equation 7 but exhibits the inverse behavior in case of non-stationarity. This means that in case of non-stationarity due to positive energy gains, $\alpha^{-}\approx 0$ is obtained, while for negative energy gains, $\alpha^{-}\approx 1$ is obtained. Hence, taking the maximum of equation 7 and equation 8, i.e., $$\alpha=\max(\alpha^{+},\alpha^{-}), \tag{9}$$

yields the desired optimal value for the recursive averaging coefficient $\alpha$, leading to a temporal averaging that corresponds to the stationarity interval of the acoustic input signals.

In other words, the signal characteristics determiner 308 is configured to determine the weighting parameter $\alpha$ based on a ratio between a current (instantaneous) signal energy of at least one (omnidirectional) component (for example, the sound pressure P(k, n)) of the acoustic input signal 104 and a temporal average over a given (previous) time segment of the signal energy of the at least one (omnidirectional) component of the acoustic input signal 104. The given time segment may for example correspond to a given number of signal energy coefficients for different (previous) time slots.

In case of a SAM analysis, the energy signal W(k,n) can be composed of the energies of the two microphone signals $X_1(k,n)$ and $X_2(k,n)$, e.g., $W(k,n)=|X_1(k,n)|^2+|X_2(k,n)|^2$. The coefficient $\alpha$ for the recursive estimation of the correlations in equation 5a or equation 5b, according to equation 5c, can be chosen appropriately using the criterion of equation 9 described above.

As can be seen from above, the controllable parameter estimator 306 may be configured to apply the temporal averaging of the intensity parameters $I_a(k, n)$ of the acoustic input signal 104 using a low pass filter (for example the mentioned infinite impulse response (IIR) filter or a finite impulse response (FIR) filter). Furthermore, the controllable parameter estimator 306 may be configured to adjust a weighting between a current intensity parameter of the acoustic audio signal 104 and previous intensity parameters of the acoustic input signal 104 based on the weighting parameter $\alpha$. In a special case of the first order IIR filter as shown with equation 5 a weighting between the current intensity parameter and one previous intensity parameter can be adjusted. The higher the weighting factor $\alpha$ the shorter the temporal averaging length is, and therefore the higher the weight of the current intensity parameter compared to the weight of the previous intensity parameters. In other words the temporal averaging length is based on the weighting parameter $\alpha$.

The controllable parameter estimator 306 may be, for example, configured such that the weight of the current intensity parameter compared to the weight of the previous intensity parameters is comparatively higher for a comparatively shorter stationarity interval and such that the weight of the current intensity parameter compared to the weight of the previous intensity parameters is comparatively lower for a comparatively longer stationarity interval. Therefore, the temporal averaging length is comparatively shorter for a comparatively shorter stationarity interval and is comparatively longer for a comparatively longer stationarity interval.

According to further embodiments of the present invention a controllable parameter estimator of a spatial audio processor according to one embodiment of the present invention may be configured to select one spatial parameter calculation rule out of a plurality of spatial parameter calculation rules for calculating the spatial parameters in dependence on the determined signal characteristic. A plurality of spatial parameter calculation rules, may, for example, differ in calculation parameters, or may even be completely different from each other. As shown with equations 4 and 5, a temporal averaging may be calculated using a block averaging as shown in equation 4 or a low pass filter as shown in equation 5. A first spatial parameter calculation rule may for example correspond with the block averaging according to equation 4 and a second parameter calculation rule may for example correspond with the averaging using the low pass filter according to equation 5. The controllable parameter estimator may choose the calculation rule out of the plurality of calculation rules, which provides the most precise estimation of the spatial parameters, based on the determined signal characteristic.

According to further embodiments of the present invention the controllable parameter estimator may be configured such that a first spatial parameter calculation rule out of the plurality of spatial parameter calculation rules is different to a second spatial parameter calculation rule out of the plurality of spatial parameter calculation rules. The first spatial parameter calculation rule and the second spatial parameter calculation rule can be selected from a group consisting of:

time averaging over a plurality of time slots in a frequency subband (for example as shown in equation 3), frequency averaging over a plurality of frequency subbands in a time slot, time and frequency averaging, spatial averaging and no averaging.

In the following this concept of choosing one spatial parameter calculation rule out of a plurality of spatial parameter calculation rules by a controllable parameter estimator will be described using two exemplary embodiments of the present invention shown in the FIGS. 4 and 5.

Figure 4:
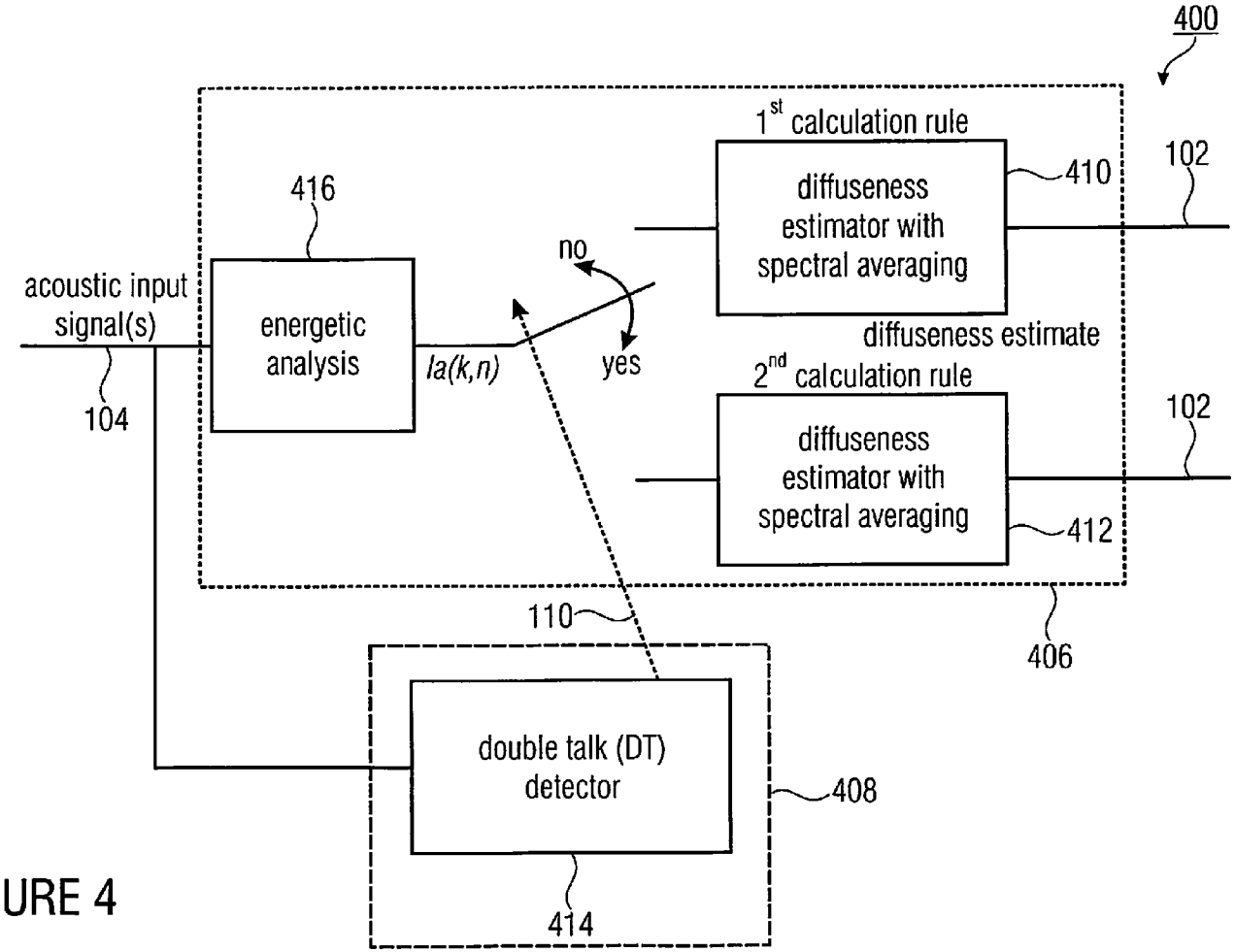
FIG. 4 shows a block schematic diagram of a spatial audio processor according to a further embodiment of the present invention.

Time Variant Direction of Arrival and Diffuseness Estimation Depending on Double Talk Using a Spatial Coder according to FIG. 4

FIG. 4 shows a block schematic diagram of a spatial audio processor 400 according to an embodiment of the present invention. A functionality of the spatial audio processor 400 may be similar to the functionality of the spatial audio processor 100 according to FIG. 1. The spatial audio processor 400 may comprise the additional features described in the following. The spatial audio processor 400 comprises a controllable parameter estimator 406, a functionality of which may be similar to the functionality of the controllable parameter estimator 106 according to FIG. 1 and which may comprise the additional features described in the following. The spatial audio processor 400 further comprises a signal characteristics determiner 408, a functionality of which may be similar to the functionality of the signal characteristics determiner 108 according to FIG. 1, and which may comprise the additional features described in the following.

The controllable parameter estimator 406 is configured to select one spatial parameter calculation rule out of a plurality of spatial parameter calculation rules for calculating spatial parameters 102, in dependence on a determined signal characteristic 110, which is determined by the signal characteristics determiner 408. In the exemplary embodiment shown in FIG. 4, the signal characteristics determiner is configured to determine if an acoustic input signal 104 comprises components from different sound sources or only comprises components from one sound source. Based on this determination the controllable parameter estimator 406 may choose a first spatial parameter calculation rule 410 for calculating the spatial parameters 102 if the acoustic input signal 104 only comprises components from one sound source and may choose a second spatial parameter calculation rule 412 for calculating the spatial parameters 102 if the acoustic input signal 104 comprises components from more than one sound source. The first spatial parameter calculation rule 410 may for example comprise a spectral averaging or frequency averaging over a plurality of frequency subbands and the second spatial parameter calculation rule 412 may not comprise spectral averaging or frequency averaging.

The determination if the acoustic input signal 104 comprises components from more than one sound source or not may be performed by a double talk detector 414 of the signal characteristics determiner 408. The parameter estimator 406 may be, for example, configured to provide a diffuseness parameter $\Psi(k, n)$ of the acoustic input signal 104 in the STFT-domain for a frequency subband k and a time block n.

In other words the spatial audio processor 400 shows a concept for improving the diffuseness estimation in directional audio coding by accounting for double talk situations.

Or in other words, the signal characteristics determiner 408 is configured to determine if the acoustic input signal 104 comprises components from different sound sources at the same time. The controllable parameter estimator 406 is configured to select in accordance with a result of the signal characteristics determination a spatial parameter calculation rule (for example the first spatial parameter calculation rule 410 or the second spatial parameter calculation rule 412) out of the plurality of spatial parameter calculation rules, for calculating the spatial parameters 102 (for example, for calculating the diffuseness parameter $\Psi(k, n)$). The first spatial parameter calculation rule 410 is chosen when the acoustic input signal 104 comprises components of at maximum one sound source and the second spatial parameter calculation rule 412 out of the plurality of spatial parameter calculation rules is chosen when the acoustic input signal 104 comprises components of more than one sound source at the same time. The first spatial parameter calculation rule 410 includes a frequency averaging (for example of intensity parameters $I_a(k, n)$) of the acoustic input signal 104 over a plurality of frequency subbands. The second spatial parameter calculation rule 412 does not include a frequency averaging.

In the example shown in FIG. 4 the estimation of the diffuseness parameter $\Psi(k, n)$ and/or a direction (of arrival) parameter $\phi(k, n)$ in the directional audio coding analysis is improved by adjusting the corresponding estimators depending on double talk situations. It has been found that the diffuseness computation in equation 2 can be realized in practice by averaging the active intensity vector $I_a(k, n)$ over frequency subbands k, or by combining a temporal and spectral averaging. However, spectral averaging is not suitable if independent diffuseness estimates are needed for the different frequency subbands, as it is the case in a so-called double talk situation, where multiple sounds sources (e.g. talkers) are active at the same time. Therefore, traditionally (as in the directional audio coder shown in FIG. 2) spectral averaging is not employed, as the general model of the acoustic input signals assumes double talk situations. It has been found that this model assumption is not optimal in the case of single talk situations, because it has been found that in single talk situations a spectral averaging can improve the parameter estimation accuracy.

The proposed novel approach, as shown in FIG. 4, chooses the optimal parameter estimation strategy (the optimal spatial parameter calculation rule) by selecting the basic model for the acoustic input signal 104 or for the acoustic input signals. In other words, FIG. 4 shows an application of an embodiment of the present invention to improve the diffuseness estimation depending on double talk situations: first the double talk detector 414 is employed which determines from the acoustic input signal 104 or the acoustic input signals whether double talk is present in the current situation or not. If not, it is decided for a parameter estimator (or in other words the controllable parameter estimator 406 chooses a spatial parameter calculation rule) which computes the diffuseness (parameter) $\Psi(k, n)$ by approximating equation 2 by using spectral (frequency) and temporal averaging of the active intensity vector $I_a(k, n)$, i.e.

$$\Psi(k, n) = \Psi(n) = 1 - \frac{|\langle\langle I_a(k, n)\rangle_n\rangle_k|}{\langle\langle|I_a(k, n)|\rangle_n\rangle_k}. \tag{10}$$

Otherwise, if double talk exists, an estimator is chosen (or in other words the controllable parameter estimator 406 chooses a spatial parameter calculation rule) that uses temporal averaging only, as in equation 3. A similar idea can be applied to the direction estimation: in case of single talk situations, but only in this case, the direction estimation $\phi(k, n)$ can be improved by a spectral averaging of the results over several or all frequency subbands k, i.e., $$\bar{\phi}(k,n)=\bar{\phi}(n)=\langle\phi(k,n)\rangle_k. \tag{11}$$

According to some embodiments of the present invention it is also conceivable to apply the (spectral) averaging on parts of the spectrum, and not on the entire bandwidth necessarily.

For performing the temporal and spectral averaging the controllable parameter estimator 406 may determine the active intensity vector $I_a(k, n)$, for example, in the SIFT-domain for each subband k and each time slot n, for example using an energetic analysis, for example by employing an energetic analyzer 416 of the controllable parameter estimator 406.

In other words, the parameter estimator 406 may be configured to determine a current diffuseness parameter $\Psi(k, n)$ for a current frequency subband k and a current time slot n of the acoustic input signal 104 based on the spectral and temporal averaging of the determined active intensity parameters $I_a(k, n)$ of the acoustic input signal 104 included in the first spatial parameter calculation rule 410 or based on only the temporal averaging of the determined active intensity vectors $I_a(k, n)$, in dependence on the determined signal characteristic.

In the following another exemplary embodiment of the present invention will be described which is also based on the concept of choosing a fitting spatial parameter calculation rule for improving the calculation of the spatial parameters of the acoustic input signal using a spatial audio processor 500 shown in FIG. 5, based on a tonality of the acoustic input signal.

Figure 5:
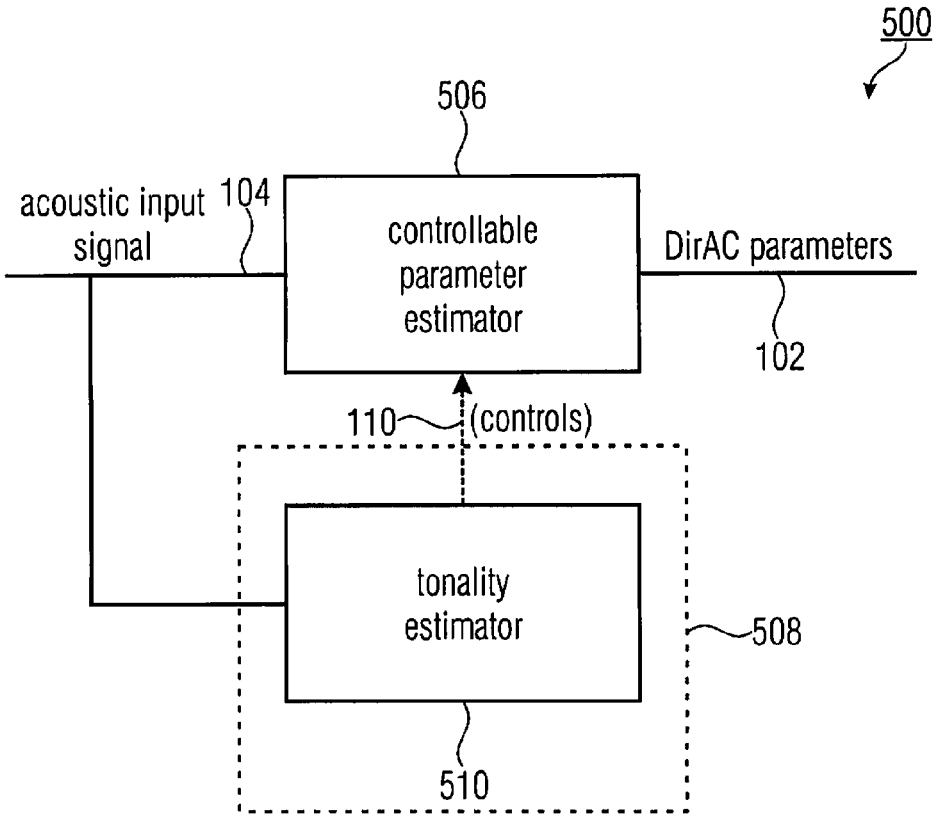
FIG. 5 shows a block schematic diagram of a spatial audio processor according to a further embodiment of the present invention.

Tonality Dependent Parameter Estimation Using a Spatial Audio Processor According to FIG. 5

FIG. 5 shows a block schematic diagram of a spatial audio processor 500 according to an embodiment of the present invention. A functionality of the spatial audio processor 500 may be similar to the functionality of spatial audio processor 100 according to FIG. 1. The spatial audio processor 500 may further comprise the additional features described in the following. The spatial audio processor 500 comprises a controllable parameter estimator 506 and a signal characteristics determiner 508. A functionality of the controllable parameter estimator 506 may be similar to the functionality of the controllable parameter estimator 106 according to FIG. 1, the controllable parameter estimator 506 may comprise the additional features described in the following. A functionality of the signal characteristics determiner 508 may be similar to the functionality of the signal characteristics determiner 108 according to FIG. 1. The signal characteristics determiner 508 may comprise the additional features described in the following.

The spatial audio processor 500 differs from the spatial audio processor 400 in the fact that the calculation of the spatial parameters 102 is modified based on a determined tonality of the acoustic input signal 104. The signal characteristics determiner 508 may determine the tonality of the acoustic input signal 104 and the controllable parameter estimator 506 may choose based on the determined tonality of the acoustic input signal 104 a spatial parameter calculation rule out of a plurality of spatial parameter calculation rules for calculating the spatial parameters 102.

In other words the spatial audio processor 500 shows a concept for improving the estimation in directional audio coding parameters by considering the tonality of the acoustic input signal 104 or of the acoustic input signals.

The signal characteristics determiner 508 may determine the tonality of the acoustic input signal using a tonality estimation, for example, using a tonality estimator 510 of the signal characteristics determiner 508. The signal characteristics determiner 508 may therefore provide the tonality of the acoustic input signal 104 or an information corresponding to the tonality of the acoustic input signal 104 as the determined signal characteristic 110 of the acoustic input signal 104.

The controllable parameter estimator 506 may be configured to select, in accordance with a result of the signal characteristics determination (of the tonality estimation), a spatial parameter calculation rule out of the plurality of spatial parameter calculation rules, for calculating the spatial parameters 102, such that a first spatial parameter calculation rule out of the plurality of spatial parameter calculation rules is chosen when the tonality of the acoustic input signal 104 is below a given tonality threshold level and such that a second spatial parameter calculation rule out of the plurality of spatial parameter calculation rules is chosen when the tonality of the acoustic input signal 104 is above a given tonality threshold level. Similar to the controllable parameter estimator 406 according to FIG. 4 the first spatial parameter calculation rule may include a frequency averaging and the second spatial parameter calculation rule may not include a frequency averaging.

Generally, the tonality of an acoustic signal provides information whether or not the signal has a broadband spectrum. A high tonality indicates that the signal spectrum contains only a few frequencies with high energy. In contrast, low tonality indicates broadband signals, i.e. signals where similar energy is present over a large frequency range.

This information on the tonality of an acoustic input signal (of the tonality of the acoustic input signal 104) can be exploited for improving, for example, the directional audio coding parameter estimation. Taking reference to the schematic block diagram shown in FIG. 5, from the acoustic input signal 104 or the acoustic input signals, first the tonality is determined (e.g. as explained in S. Molla and B. Torresani: Determining Local Transientness of Audio Signals, IEEE Signal Processing Letters, Vol. 11, No. 7, July 2007) of the input using the tonality detector or tonality estimator 510. The information on the tonality (the determined signal characteristic 110) controls the estimation of the directional audio coding parameters (of the spatial parameters 102). An output of the controllable parameter estimator 506 are the spatial parameters 102 with increased accuracy compared to the traditional method shown with the directional audio coder according to FIG. 2.

The estimation of the diffuseness $\Psi(k,n)$ can gain from the knowledge of the input signal tonality as follows: The computation of the diffuseness $\Psi(k,n)$ needs an averaging process as shown in equation 3. This averaging is traditionally carried out only along time n. Particularly in diffuse sound fields, an accurate estimation of the diffuseness is only possible when the averaging is sufficiently long. A long temporal averaging however is usually not possible due the short stationary interval of the acoustic input signals. To improve the diffuseness estimation, we can combine the temporal averaging with a spectral averaging over the frequency bands k, i.e., $$\Psi(k, n) = 1 - \frac{|\langle\langle I_a(k, n)\rangle_n\rangle_k|}{\langle\langle|I_a(k, n)|\rangle_n\rangle_k}. \tag{12}$$

However, this method may need broadband signals where the diffuseness is similar for different frequency bands. In case of tonal signals, where only few frequencies possess significant energy, the true diffuseness of the sound field can vary strongly along the frequency bands k. This means, when the tonality detector (the tonality estimator 510 of the signal characteristics determiner 508) indicates a high tonality of the acoustic signal 104 then the spectral averaging is avoided.

In other words, the controllable parameter estimator 506 is configured to derive the spatial parameters 102, for example a diffuseness parameter $\Psi(k, n)$, for example, in the STFT-domain for a frequency subband k and a time slot n based on a temporal and spectral averaging of intensity parameters $I_a(k, n)$ of the acoustic input signal 104 if the determined tonality of the acoustic signal 104 is comparatively small, and to provide the spatial parameters 102, for example, the diffuseness parameter $\Psi(k, n)$ based on only a temporal averaging and no spectral averaging of the intensity parameters $I_a(k, n)$ of the acoustic input signal 104 if the determined tonality of the acoustic input signal 104 is comparatively high.

The same idea can be applied to the estimation of the direction (of arrival) parameter $\phi(k, n)$ to improve the signal-to-noise ratio of the results (of the determined spatial parameters 102). In other words, the controllable parameter estimator 506 may be configured to determine the direction of arrival parameter $\phi(k, n)$ based on a spectral averaging if the determined tonality of the acoustic input signal 104 is comparatively small and to derive the direction of arrival parameter $\phi(k, n)$ without performing a spectral averaging if the tonality is comparatively high.

This idea of improving the signal-to-noise ratio by spectral averaging the direction of arrival parameter $\phi(k, n)$ will be described in the following in more details using another embodiment of the present invention. The spectral averaging can be applied to the acoustic input signal 104 or the acoustic input signals, to the active sound intensity, or directly to the direction (of arrival) parameter $\phi(k, n)$.

For a person skilled in the art it becomes clear that the spatial audio processor 500 can also be applied to the spatial audio microphone analysis in a similar way with the difference that now the expectation operators in equation 5a and equation 5b are approximated by considering a spectral averaging in case no double talk is present or in case of a low tonality.

In the following, two other embodiments of the present invention will be explained, which perform a signal-to-noise ratio dependent direction estimation for improving the calculation of the spatial parameters.

Figure 6:
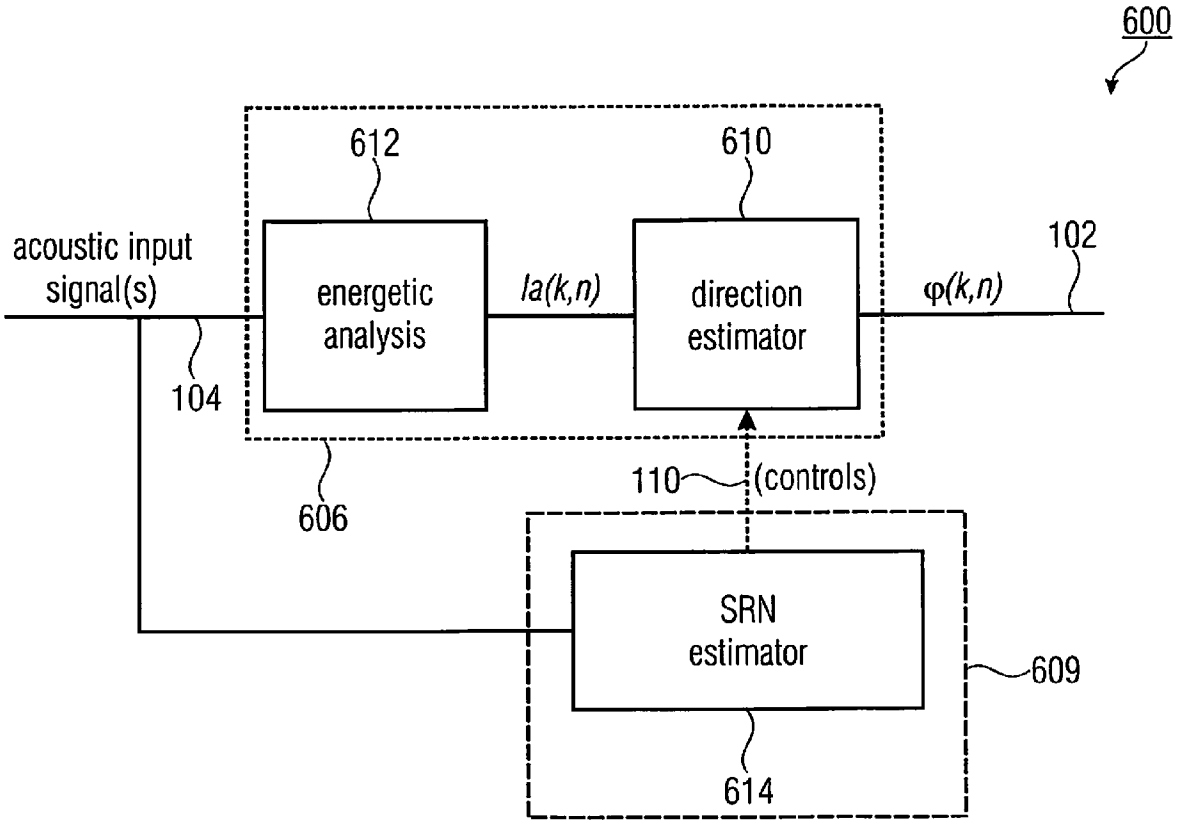
FIG. 6 shows a block schematic diagram of a spatial audio processor according to a further embodiment of the present invention.

Signal-to Noise Ratio Dependent Direction Estimation Using a Spatial Audio Processor according to FIG. 6

FIG. 6 shows a block schematic diagram of spatial audio processor 600. The spatial audio processor 600 is configured to perform the above mentioned signal-to-noise ratio dependent direction estimation.

A functionality of the spatial audio processor 600 may be similar to the functionality of the spatial audio processor 100 according to FIG. 1. The spatial audio processor 600 may comprise the additional features described in the following. The spatial audio processor 600 comprises a controllable parameter estimator 606 and a signal characteristics determiner 608. A functionality of the controllable parameter estimator 606 may be similar to the functionality of the controllable parameter estimator 106 according to FIG. 1, and the controllable parameter estimator 606 may comprise the additional features described in the following. A functionality of the signal characteristics determiner 608 may be similar to the functionality of the signal characteristics determiner 108 according to FIG. 1, and the signal characteristics determiner 608 may comprise the additional features described in the following.

The signal characteristics determiner 608 may be configured to determine a signal-to-noise ratio (SNR) of an acoustic input signal 104 as a signal characteristic 110 of the acoustic input signal 104. The controllable parameter estimator 606 may be configured to provide a variable spatial calculation rule for calculating spatial parameters 102 of the acoustic input signal 104 based on the determined signal-to-noise ratio of the acoustic input signal 104.

The controllable parameter estimator 606 may for example perform a temporal averaging for determining the spatial parameters 102 and may vary an averaging length of the temporal averaging (or a number of elements used for the temporal averaging) in dependence on the determined signal-to-noise ratio of the acoustic input signal 104. For example, the parameter estimator 606 may be configured to vary the averaging length of the temporal averaging such that the averaging length is comparatively high for a comparatively low signal-to-noise ratio of the acoustic input signal 104 and such that the averaging length is comparatively low for a comparatively high signal to noise ratio of the acoustic input signal 104.

The parameter estimator 606 may be configured to provide a direction of arrival parameter $\phi(k, n)$ as spatial parameter 102 based on the mentioned temporal averaging. As mentioned before, the direction of arrival parameter $\phi(k, n)$ may be determined in the controllable parameter estimator 606 (for example in a direction estimator 610 of the parameter estimator 606) for each frequency subband k and time slot n as the opposite direction of the active sound intensity vector $I_a(k, n)$. The parameter estimator 606 may therefore comprise an energetic analyzer 612 to perform an energetic analysis on the acoustic input signal 104 to determine the active sound intensity vector $I_a(k, n)$ for each frequency subband k and each time slot n. The direction estimator 610 may perform the temporal averaging, for example, on the determined active intensity vector $I_a(k, n)$ for a frequency subband k over a plurality of time slots n. In other words, the direction estimator 610 may perform a temporal averaging of intensity parameters $I_a(k, n)$ for one frequency subband k and a plurality of (previous) time slots to calculate the direction of arrival parameter $\phi(k, n)$ for a frequency subband k and a time slot n. According to further embodiments of the present invention the direction estimator 610 may also (for example instead of a temporal averaging of the intensity parameters $I_a(k, n)$) perform the temporal averaging on a plurality of determined direction of arrival parameters $\phi(k, n)$ for a frequency subband k and a plurality of (previous) time slots. The averaging length of the temporal averaging corresponds therefore with the number of intensity parameters or the number of direction of arrival parameters used to perform the temporal averaging. In other words, the parameter estimator 606 may be configured to apply the temporal averaging to a subset of intensity parameters $I_a(k, n)$ for a plurality of time slots and a frequency subband k or to a subset of direction of arrival parameters $\phi(k, n)$ for a plurality of time slots and a frequency subband k. The number of intensity parameters in the subset of intensity parameters or the number of direction of arrival parameters in the subset of direction of arrival parameters used for the temporal averaging corresponds to the averaging length of the temporal averaging. The controllable parameter estimator 606 is configured to adjust the number of intensity parameters or the number of direction of arrival parameters in the subset used for calculating the temporal averaging such that the number of intensity parameters in the subset of intensity parameters or the number of direction of arrival parameters in the subset of direction of arrival parameters is comparatively low for a comparatively high signal-to-noise ratio of the acoustic input signal 104 and such that the number of intensity parameters or the number of direction of arrival parameters is comparatively high for a comparatively low signal-to-noise ratio of the acoustic input signal 104.

In other words, the embodiment of the present invention provides a directional audio coding direction estimation which is based on the signal-to-noise ratio of the acoustic input signals or of the acoustic input signal 104.

Generally, the accuracy of the estimated direction $\phi(k, n)$ (or of the direction of arrival parameter $\phi(k, n)$) of the sound, defined in accordance with the directional audio coder 200 according to FIG. 2, is influenced by noise, which is present within the acoustic input signals.

The impact of noise on the estimation accuracy depends on the SNR, i.e., on the ratio between the signal energy of the sound which arrives at the (microphone) array and the energy of the noise. A small SNR significantly reduces the estimation accuracy of the direction $\phi(k,n)$. The noise signal is usually introduced by the measurement equipment, e.g., the microphones and the microphone amplifier, and leads to errors in $\phi(k,n)$. It has been found that the direction $\phi(k,n)$ is with equal probability either under estimated or over estimated, but the expectation of $\phi(k,n)$ is still correct.

It has been found that having several independent estimations of the direction of arrival parameter $\phi(k, n)$, e.g. by repeating the measurement several times, the influence of noise can be reduced and thus the accuracy of the direction estimation can be increased by averaging the direction of arrival parameter $\phi(k,n)$ over the several measurement instances. Effectively, the averaging process increases the signal-to-noise ratio of the estimator. The smaller the signal-to-noise ratio at the microphones, or in general at the sound recording devices, or the higher the desired target signal-to-noise ratio in the estimator, the higher is the number of measurement instances which may be needed in the averaging process.

The spatial coder 600 shown in FIG. 6 performs this averaging process in dependence on the signal to noise ratio of the acoustic input signal 104. Or in other words the spatial audio processor 600 shows a concept for improving the direction estimation in directional audio coding by accounting for the SNR at the acoustic input or of the acoustic input signal 104.

Before estimating the direction $\phi(k, n)$ with the direction estimator 610, the signal-to-noise ratio of the acoustic input signal 104 or of the acoustic input signals is determined with the signal-to-noise ratio estimator 614 of the signal characteristics determiner 608. The signal-to-noise ratio can be estimated for each time block n and frequency band k, for example, in the STFT-domain. The information on the actual signal-to-noise ratio of the acoustic input signal 104 is provided as the determined signal characteristic 110 from the signal-to-noise ratio estimator 614 to the direction estimator 610 which includes a frequency and time dependent temporal averaging of specific directional audio coding signals for improving the signal-to-noise ratio. Furthermore, a desired target signal-to-noise ratio can be passed to the direction estimator 610. The desired target signal-to-noise ratio may be defined externally, for example, by a user. The direction estimator 610 may adjust the averaging length of the temporal averaging such that a achieved signal-to-noise ratio of the acoustic input signal 104 at an output of the controllable parameter estimator 606 (after averaging) matches the desired signal-to-noise ratio. Or in other words, the averaging (in the direction estimator 610) is carried out until the desired target signal-to-noise ratio is obtained.

The direction estimator 610 may continuously compare the achieved signal-to-noise ratio of the acoustic input signal 104 with the target signal-to-noise ratio and may perform the averaging until the desired target signal-to-noise ratio is achieved. Using this concept, the achieved signal-to-noise ratio acoustic input signal 104 is continuously monitored and the averaging is ended, when the achieved signal-to-noise ratio of the acoustic input signal 104 matches the target signal-to-noise ratio, thus, there is no need for calculating the averaging length in advance.

Furthermore, the direction estimator 610 may determine based on the signal-to-noise ratio of the acoustic input signal 104 at the input of the controllable parameter estimator 606 the averaging length for the averaging of the signal-to-noise ratio of the acoustic input signal 104, such that the achieved signal-to-noise ratio of the acoustic input signal 104 at the output of the controllable parameter estimator 606 matches the target signal-to-noise. Thus, using this concept, the achieved signal-to-noise ratio of the acoustic input signal 104 is not monitored continuously.

A result generated by the two concepts for the direction estimator 610 described above is the same: During the estimation of the spatial parameters 102, one can achieve a precision of the spatial parameters 102 as if the acoustic input signal 104 has the target signal-to-noise ratio, although the current signal-to-noise ratio of the acoustic input signal 104 (at the input of the controllable parameter estimator 606) is worse.

The smaller the signal-to-noise ratio of the acoustic input signal 104 compared to the target signal-to-noise ratio, the longer the temporal averaging. An output of the direction estimator 610 is, for example, an estimate $\phi(k,n)$, i.e. the direction of arrival parameter $\phi(k, n)$ with increased accuracy. As mentioned before, different possibilities for averaging the directional audio coding signals exists: averaging the active sound intensity vector $I_a(k, n)$ for one frequency subband k and a plurality of time slots provided by equation 1 or averaging directly the estimated direction $\phi(k, n)$ (the direction of arrival parameter $\phi(k, n)$) defined already before as the opposite direction of the active sounds intensity vector $I_a(k, n)$ along time.

The spatial audio processor 600 may also be applied to the spatial audio microphone direction analysis in a similar way. The accuracy of the direction estimation can be increased by averaging the results over several measurement instances. This means that similar to DirAC in FIG. 6, the SAM estimator is improved by first determining the SNR of the acoustic input signal(s) 104. The information on the actual SNR and the desired target SNR is passed to SAM's direction estimator which includes a frequency and time dependent temporal averaging of specific SAM signals for improving the SNR. The averaging is carried out until the desired target SNR is obtained. In fact, two SAM signals can be averaged, namely the estimated direction $\phi(k,n)$ or the PSDs and CSDs defined in equation 5a and equation 5b. The latter averaging simply means that the expectation operators are approximated by an averaging process whose length depends on the actual and the desired (target) SNR. The averaging of the estimated direction $\phi(k,n)$ is explained for DirAC in accordance with FIG. 7*b*, but holds in the same way for SAM.

According to a further embodiment of the present invention, which will be explained later using FIG. 8, instead of explicitly averaging the physical quantities with these two methods, it is possible to switch a used filter bank, as the filter bank may contain an inherent averaging of the input signals. In the following the two mentioned methods for averaging the directional audio coding signals will be explained in more detail using FIGS. 7*a* and 7*b*. The alternative method of switching the filter bank with a spatial audio processor is shown in FIG. 8.

Figure 7A:
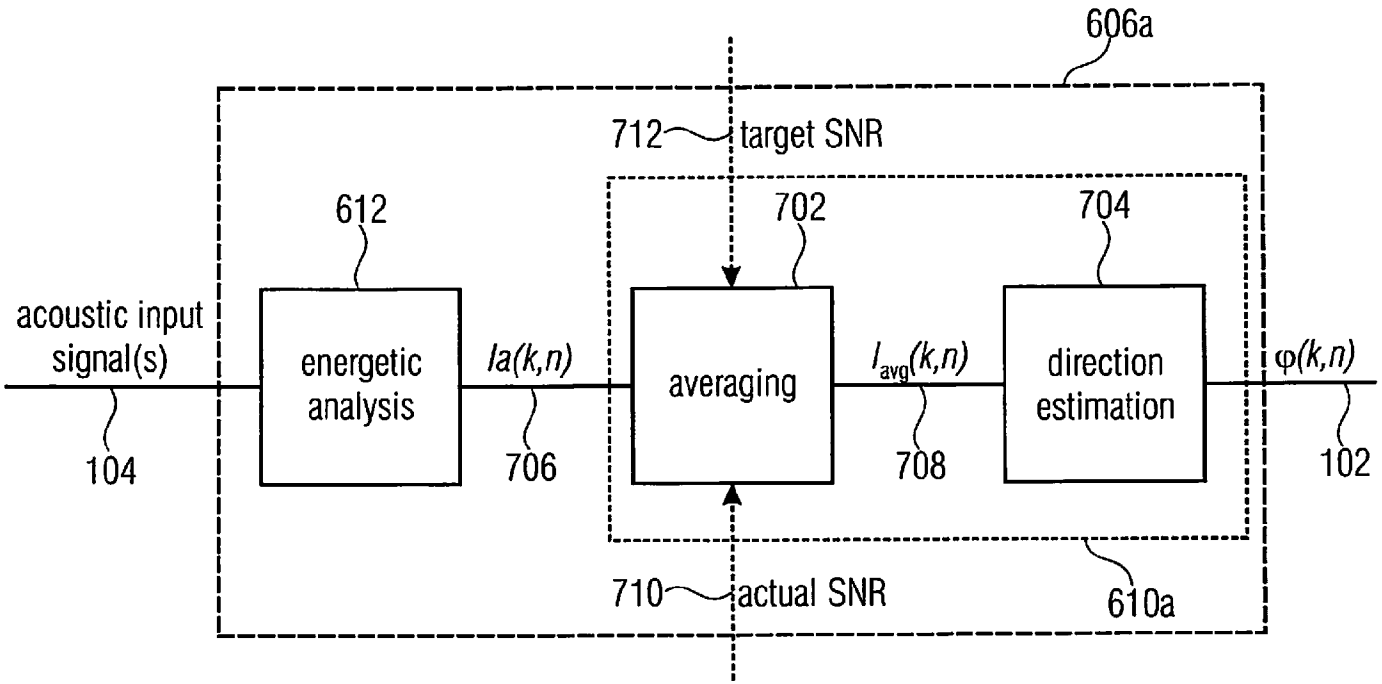
FIG. 7*a* shows a block schematic diagram of a parameter estimator which can be used in a spatial audio processor according to an embodiment of the present invention.
Figure 8:
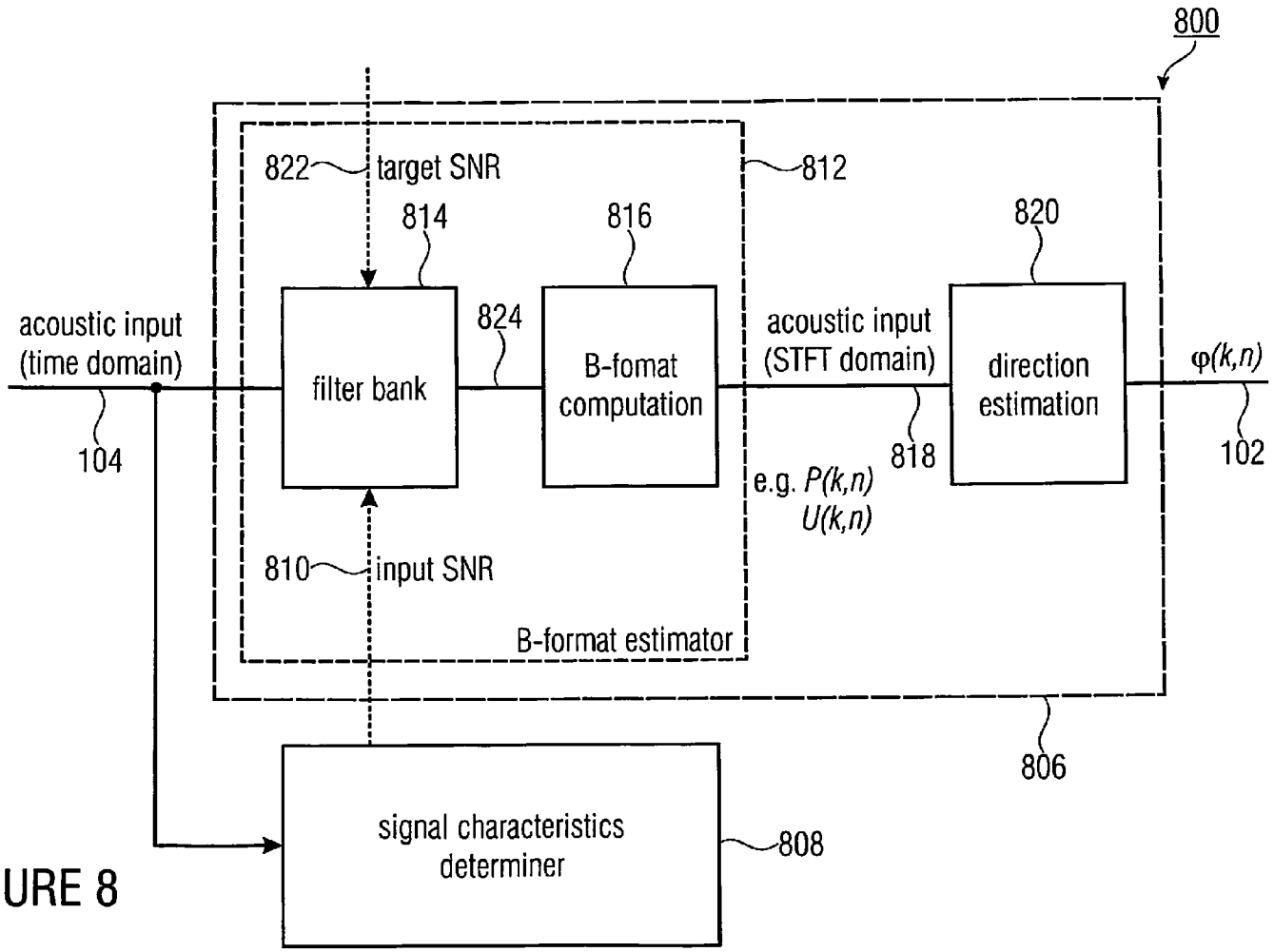
FIG. 8 shows a block schematic diagram of a spatial audio processor according to a further embodiment of the present invention.

Averaging of the Active Sound Density Vector in Directional Audio Coding According to FIG. 7*a*

FIG. 7*a* shows in a schematic block diagram a first possible realization of the signal-to-noise ratio dependent direction estimator 610 in FIG. 6. The realization, which is shown in FIG. 7*a*, is based on a temporal averaging of the acoustic sound intensity or of the sound intensity parameters $I_a(k, n)$ by a direction estimator 610*a*. The functionality of the direction estimator 610*a* may be similar to a functionality of the direction estimator 610 from FIG. 6, wherein the direction estimator 610*a* may comprise the additional features described in the following.

The direction estimator 610*a* is configured to perform an averaging and a direction estimation. The direction estimator 610*a* is connected to the energetic analyzer 612 from FIG. 6, the direction estimator 610 with the energetic analyzer 612 may constitute a controllable parameter estimator 606*a*, a functionality of which is similar to the functionality of the controllable parameter estimator 606 shown in FIG. 6. The controllable parameter estimator 606*a* firstly determines from the acoustic input signal 104 or the acoustic input signals an active sound intensity vector 706 ($I_a(k, n)$) in the energetic analysis using the energetic analyzer 612 using equation 1 as explained before. In an averaging block 702 of the direction estimator 610*a* performing the averaging this vector (the sound intensity vector 706) is averaged along time n, independently for all (or at least a part of all) frequency bands or frequency subbands k, which leads to an averaged acoustic intensity vector 708 ($I_{avg}(k, n)$) according to the following equation:

$$I_{avg}(k,n)=\langle I_a(k,n)\rangle_n. \quad (13)$$

To carry out the averaging the direction estimator 610*a* considers the past intensity estimates. One input to the averaging block 702 is the actual signal-to-noise ratio 710 of the acoustic input 104 or of the acoustic input signal 104, which is determined with the signal-to-noise ratio estimator 614 shown in FIG. 6. The actual signal-to-noise ratio 710 of the acoustic input signal 104 constitutes the determined signal characteristic 110 of the acoustic input signal 104. The signal-to-noise ratio is determined for each frequency subband k and each time slot n in the short time frequency domain. A second input to the averaging block 702 is a desired signal-to-noise ratio or a target signal-to-noise ratio 712, which should be obtained at an output of the controllable parameter estimator 606*a*, i.e. the target signal-to-noise ratio. The target signal-to-noise ratio 712 is an external input, given for example by the user. The averaging block 702 averages the intensity vector 706 ($I_a(k, n)$) until the target signal-to-noise ratio 712 is achieved. On the basis of the averaged (acoustic) intensity vector 708 ($I_{avg}(k, n)$) finally the direction $\phi(k, n)$ of the sound can be computed using a direction estimation block 704 of the direction estimator 610*a* performing the direction estimation, as explained before. The direction of arrival parameter $\phi(k, n)$ constitutes a spatial parameter 102 determined by the controllable parameter estimator 606*a*. The direction estimator 610*a* may determine the direction of arrival parameter $\phi(k, n)$ for each frequency subband k and time slot n as the opposite direction of the averaged sound intensity vector 708 ($I_{avg}(k, n)$) of the corresponding frequency subband k and the corresponding time slot n.

Depending on the desired target signal-to-noise ratio 712 the controllable parameter estimator 610*a* may vary the averaging length for the averaging of the sound intensity parameters 706 ($I_a(k, n)$) such that a signal-to-noise ratio at the output of the controllable parameter estimator 606*a* matches (or is equal to) the target signal-to-noise ratio 712. Typically, the controllable parameter estimator 610*a* may choose a comparatively long averaging length for a comparatively high difference between the actual signal-to-noise ratio 710 of the acoustic input signal 104 and the target signal-to-noise ratio 712. For a comparatively low difference between the actual signal-to-noise ratio 710 of the acoustic input signal 104 and the target signal-to-noise ratio 712 the controllable parameter estimator 610*a* will choose a comparatively short averaging length.

Or in other words the direction estimator 606*a* is based on averaging the acoustic intensity of the acoustic intensity parameters.

Figure 7B:
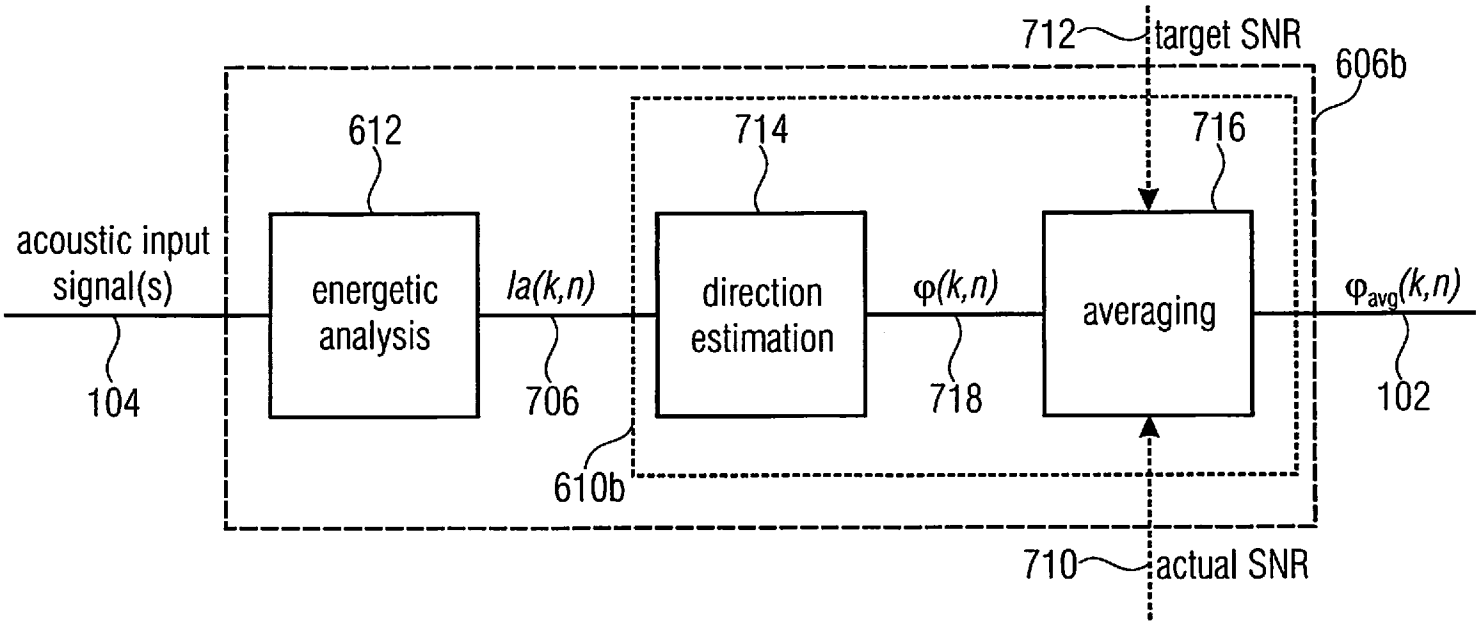
FIG. 7*b* shows a block schematic diagram of a parameter estimator, which can be used in a spatial audio processor according to an embodiment of the present invention.

Averaging the Directional Audio Coding Direction Parameter Directly according to FIG. 7*b*

FIG. 7*b* shows a block schematic diagram of a controllable parameter estimator 606*b*, a functionality of which may be similar to the functionality of the controllable parameter estimator 606 shown in FIG. 6. The controllable parameter estimator 606*b* comprises the energetic analyzer 612 and a direction estimator 610*b* configured to perform a direction estimation and an averaging. The direction estimator 610*b* differs from the direction estimator 610*a* in that it firstly performs a direction estimation to determine a direction of arrival parameter 718 ($\phi(k, n)$) for each frequency subband k and each time slot n and secondly performs the averaging on the determined direction of arrival parameter 718 to determine an averaged direction of arrival parameter $\phi_{avg}(k, n)$ for each frequency subband k and each time slot n. The averaged direction of arrival parameter $\phi_{avg}(k, n)$ constitutes a spatial parameter 102 determined by the controllable parameter estimator 606*b*.

In other words, FIG. 7*b* shows another possible realization of the signal-to-noise ratio dependent direction estimator 610, which is shown in FIG. 6. The realization, which is shown in FIG. 7*b*, is based on a temporal averaging of the estimated direction (the direction of arrival parameter 718 ($\phi$(k, n)) which can be obtained with a conventional audio coding approach, for example for each frequency subband k and each time slot n as the opposite direction of the active sound intensity vector 706 ($I_a$(k, n)).

From the acoustic input or the acoustic input signal 104 the energetic analysis is performed using the energetic analyzer 612 and then the direction of sound (the direction of arrival parameter 718 ($\phi$(k, n)) is determined in a direction estimation block 714 of the direction estimator 610*b* performing the direction estimation, for example, with a conventional directional audio coding method explained before. Then in an averaging block 716 of the direction estimator 610*b* a temporal averaging is applied on this direction (on the direction of arrival parameter 718 ($\phi$(k, n)). As explained before, the averaging is carried out along time and for all (or at least for part of all) frequency bands or frequency subbands k, which yields the averaged direction $\phi_{avg}$(k, n):

$$\phi_{avg}(k,n)=<\phi(k,n)>_n. \tag{14}$$

The averaged direction $\phi_{avg}$(k, n) for each frequency subband k and each time slot n constitutes a spatial parameter 102 determined by the controllable parameter estimator 606*b*.

As described before, inputs to the averaging block 716 are the actual signal-to-noise ratio 710 of the acoustic input or of the acoustic input signal 104 as well as the target signal-to-noise ratio 712, which shall be obtained at an output of the controllable parameter estimator 606*b*. The actual signal-to-noise ratio 710 is determined for each frequency subband k and each time slot n, for example, in the STFT-domain. The averaging 716 is carried out over a sufficient number of time blocks (or time slots) until the target signal-to-noise ratio 712 is achieved. The final result is the temporal averaged direction $\phi_{avg}$(k, n) with increased accuracy.

To summarize in short, the signal characteristics determiner 608 is configured to provide the signal-to-noise ratio 710 of the acoustic input signal 104 as a plurality of signal-to-noise ratio parameters for a frequency subband k and a time slot n of the acoustic input signal 104. The controllable parameter estimators 606*a*, 606*b* are configured to receive the target signal-to-noise ratio 712 as a plurality of target signal-to-noise ratio parameters for a frequency subband k and a time slot n. The controllable parameter estimators 606*a*, 606*b* are further configured to derive the averaging length of the temporal averaging in accordance with a current signal-to-noise ratio parameter of the acoustic input signal such that a current signal-to-noise ratio parameter of the current (averaged) direction of arrival parameter $\phi_{avg}$(k, n) matches a current target signal-to-noise ratio parameter.

The controllable parameter estimators 606*a*, 606*b* are configured to derive intensity parameters $I_a$(k, n) for each frequency subband k and each time slot n of the acoustic input signal 104. Furthermore, the controllable parameter estimators 606, 606*b* are configured to derive direction of arrival parameters $\phi$(k, n) for each frequency subband k and each time slot n of the acoustic input signal 104 based on the intensity parameters $I_a$(k, n) of the acoustic audio signal determined by the controllable parameter estimators 606*a*, 606*b*. The controllable parameter estimators 606*a*, 606*b* are further configured to derive the current direction of arrival parameter $\phi$(k, n) for a current frequency subband and a current time slot based on the temporal averaging of at least a subset of derived intensity parameters of the acoustic input signal 104 or based on the temporal averaging of at least a subset of derived direction of arrival parameters.

The controllable parameter estimators 606*a*, 606*b* are configured to derive the intensity parameters $I_a$(k, n) for each frequency subband k and each time slot n, for example, in the SIFT-domain, furthermore the controllable parameter estimators 606*a*, 606*b* are configured to derive the direction of arrival parameter $\phi$(k, n) for each frequency subband k and each time slot n, for example, in the SIFT-domain. The controllable parameter estimator 606*a* is configured to choose the subset of intensity parameters for performing the temporal averaging such that a frequency subchannel associated to all intensity parameters of the subset of intensity parameters is equal to a current frequency subband associated to the current direction of arrival parameter. The controllable parameter 606*b* is configured to choose the subset of direction of arrival parameters for performing the temporal averaging 716 such that a frequency subchannel associated to all direction of arrival parameters of the subset of direction of arrival parameters is equal to the current frequency subchannel associated to the current direction of arrival parameter.

Furthermore, the controllable parameter estimator 606*a* is configured to choose the subset of intensity parameters such that time slots associated to the intensity parameters of the subset of intensity parameters are adjacent in time. The controllable parameter estimator 606*b* is configured to choose the subset of direction of arrival parameters such that time slots associated to the direction of arrival parameters of the subset of direction of arrival parameters are adjacent in time. The number of intensity parameter in the subset of intensity parameters or the number of direction of arrival parameters in the subset of direction of arrival parameters correspond with the averaging length of the temporal averaging. The controllable parameter estimator 606*a* is configured to derive the number of intensity parameters in the subset of intensity parameters for performing the temporal averaging in dependence on the difference between the current signal-to-noise ratio of the acoustic input signal 104 and the current target signal-to-noise ratio. The controllable parameter estimator 606*b* is configured to derive the number of direction of arrival parameters in the subset of direction of arrival parameters for performing the temporal averaging based on the difference between the current signal-to-noise ratio of the acoustic input signal 104 and the current target signal-to-noise ratio.

Or in other words the direction estimator 606*b* is based on averaging the direction 718 $\phi$(k, n) obtained with a conventional directional audio coding approach.

In the following another realization of a spatial audio processor will be described, which also performs a signal-to-noise ratio dependent parameter estimation.

Using a Filter Bank with an Appropriate Spectro-Temporal Resolution in Directional Audio Coding Using an Audio Coder According to FIG. 8

FIG. 8 shows a spatial audio processor 800 comprising a controllable parameter estimator 806 and a signal characteristics determiner 808. A functionality of the directional audio coder 800 may be similar to the functionality of the directional audio coder 100. The directional audio coder 800 may comprise the additional features described in the following. A functionality of the controllable parameter estimator 806 may be similar to the functionality of the controllable parameter estimator 106 and a functionality of the signal characteristics determiner 808 may be similar to a functionality of the signal characteristics determiner 108. The controllable parameter estimator 806 and the signal characteristics determiner 808 may comprise the additional features described in the following.

The signal characteristics determiner 808 differs from the signal characteristics determiner 608 in that it determines a signal-to-noise ratio 810 of the acoustic input signal 104, which is also denoted as input signal-to-noise ratio, in the time domain and not in the STFT-domain. The signal-to-noise ratio 810 of the acoustic input signal 104 constitutes a signal characteristic determined by the signal characteristic determiner 808. The controllable parameter estimator 806 differs from the controllable parameter estimator 606 shown in FIG. 6 in that it comprises a B-format estimator 812 comprising a filter bank 814 and a B-format computation block 816, which is configured to transform the acoustic input signal 104 in the time domain to the B-format representation, for example, in the STFT-domain.

Furthermore, the B-format estimator 812 is configured to vary the B-format determination of the acoustic input signal 104 based on the determined signal characteristics by the signal characteristics determiner 808 or in other words in dependence on the signal-to-noise ratio 810 of the acoustic input signal 104 in the time domain.

An output of the B-format estimator 812 is a B-format representation 818 of the acoustic input signal 104. The B-format representation 818 comprises an omnidirectional component, for example the above mentioned sound pressure vector P(k, n) and a directional component, for example, the above mentioned sound velocity vector U(k, n) for each frequency subband k and each time slot n.

A direction estimator 820 of the controllable parameter estimator 806 derives a direction of arrival parameter $\phi(k, n)$ of the acoustic input signal 104 for each frequency subband k and each time slot n. The direction of arrival parameter $\phi(k, n)$ constitutes a spatial parameter 102 determined by the controllable parameter estimator 806. The direction estimator 820 may perform the direction estimation by determining an active intensity parameter $I_a(k, n)$ for each frequency subband k and each time slot n and by deriving the direction of arrival parameters $\phi(k, n)$ based on the active intensity parameters $I_a(k, n)$.

The filter bank 814 of the B-format estimator 812 is configured to receive the actual signal-to-noise ratio 810 of the acoustic input signal 104 and to receive a target signal-to-noise ratio 822. The controllable parameter estimator 806 is configured to vary a block length of the filter bank 814 in dependence on a difference between the actual signal-to-noise ratio 810 of the acoustic input signal 104 and the target signal-to-noise ratio 822. An output of the filter bank 814 is a frequency representation (e.g. in the STFT-domain) of the acoustic input signal 104, based on which the B-format computation block 816 computes the B-format representation 818 of the acoustic input signal 104. In other words the conversion of the acoustic input signal 104 from the time domain to the frequency representation can be performed by the filter bank 814 in dependence on the determined actual signal-to-noise ratio 810 of the acoustic input signal 104 and in dependence on the target signal-to-noise ratio 822. In short, the B-format computation can be performed by the B-format computation block 816 in dependence on the determined actual signal-to-noise ratio 810 and the target signal-to-noise ratio 822.

In other words, the signal characteristics determiner 808 is configured to determine the signal-to-noise ratio 810 of the acoustic input signal 104 in the time domain. The controllable parameter estimator 806 comprises the filter bank 814 to convert the acoustic input signal 104 from the time domain to the frequency representation. The controllable parameter estimator 806 is configured to vary the block length of the filter bank 814, in accordance with the determined signal-to-noise ratio 810 of the acoustic input signal 104. The controllable parameter estimator 806 is configured to receive the target signal-to-noise ratio 812 and to vary the block length of the filter bank 814 such that the signal-to-noise ratio of the acoustic input signal 104 in the frequency domain matches the target signal-to-noise ratio 824 or in other words such that the signal-to-noise ratio of the frequency representation 824 of the acoustic input signal 104 matches the target signal-to-noise ratio 822.

The controllable parameter estimator 806 shown in FIG. 8 can also be understood as another realization of the signal-to-noise ratio dependent direction estimator 610 shown in FIG. 6. The realization that is shown in FIG. 8 is based on choosing an appropriate spectral temporal resolution of the filter bank 814. As explained before, directional audio coding operates in the STFT-domain. Thus, the acoustic input signals or the acoustic input signal 104 in the time domain, for example measured with microphones are transformed using for instance a short time Fourier transformation or any other filter bank. The B-format estimator 812 then provides the short time frequency representation 818 of the acoustic input signal 104 or in other words, provides the B-format signal as denoted by the sound pressure P(k, n) and the particular velocity vector U(k, n), respectively. Applying the filter bank 814 on the acoustic time domain input signals (on the acoustic input signal 104 in the time domain) inherently averages the transformed signal (the short time frequency representation 824 of the acoustic input signal 104), whereas the averaging length corresponds to the transform length (or block length) of the filter bank 814. The averaging method described in conjunction with the spatial audio processor 800 exploits this inherent temporal averaging of the input signals.

The acoustic input or the acoustic input signal 104, which may be measured with the microphones, is transformed into the short time frequency domain using the filter bank 814. The transform length, or filter length, or block length is controlled by the actual input signal-to-noise ratio 810 of the acoustic input signal 104 or of the acoustic input signals and the desired target signal-to-noise ratio 822, which should be obtained by the averaging process. In other words, it is desired to perform the averaging in the filter bank 814 such that the signal-to-noise ratio of the time frequency representation 824 of the acoustic input signal 104 matches or is equal to the target signal-to-noise ratio 822. The signal-to-noise ratio is determined from the acoustic input signal 104 or the acoustic input signals in time domain. In case of a high input signal-to-noise ratio 810, a shorter transform length is chosen, and vice versa for a low input signal-to-noise ratio 810, a longer transform length is chosen. As explained in the previous section, the input signal-to-noise ratio 810 of the acoustic input signal 104 is provided by a signal-to-noise ratio estimator of the signal characteristics determiner 808, while the target signal-to-noise ratio 822 can be controlled externally, for example, by a user. The output of the filter bank 814 and the subsequent B-format computation performed by the B-format computation block 816 are the acoustic input signals 818, for example, in the SIFT domain, namely P(k, n) and/or U(k, n). These signals (the acoustic input signal 818 in the STFT domain) are processed further, for example with the conventional directional audio coding processing in the direction estimator 820 to obtain the direction $\phi(k, n)$ for each frequency subband k and each time slot n.

Or in other words, the spatial audio processor 800 or the direction estimator is based on choosing an appropriate filter bank for the acoustic input signal 104 or for the acoustic input signals.

In short, the signal characteristics determiner 808 is configured to determine the signal-to-noise ratio 810 of the acoustic input signal 104 in the time domain. The controllable parameter estimator 806 comprises the filter bank 814 configured to convert the acoustic input signal 104 from the time domain to the frequency representation. The controllable parameter estimator 806 is configured to vary the block length of the filter bank 814, in accordance with the determined signal-to-noise ratio 810 of the acoustic input signal 104. Furthermore, the controllable parameter estimator 806 is configured to receive the target signal-to-noise ratio 822 and to vary the block length of the filter bank 814 such that the signal-to-noise ratio of the acoustic input signal 824 in the frequency representation matches the target signal-to-noise ratio 822.

The estimation of the signal-to-noise ratio performed by the signal characteristics determiner 608, 808 is a well known problem. In the following a possible implementation of a signal-to-noise ratio estimator shall be described.

Possible Implementation of an SNR Estimator

In the following a possible implementation of the input signal-to-noise ratio estimator 614 in FIG. 600 will be described. The signal-to-noise ratio estimator described in the following can be used for the controllable parameter estimator 606*a* and the controllable parameter estimator 606*b* shown in FIGS. 7*a* and 7*b*. The signal-to-noise ratio estimator estimates the signal-to-noise ratio of the acoustic input signal 104, for example, in the STFT-domain. A time domain implementation (for example implemented in the signal characteristics determiner 808) can be realized in a similar way.

The SNR estimator may estimate the SNR of the acoustic input signals, for example, in the STFT domain for each time block n and frequency band k, or for a time domain signal. The SNR is estimated by computing the Signal power for the considered time-frequency bin. Let x(k,n) be the acoustic input signal. The signal power S(k,n) can be determined with $$S(k,n)=|x(k,n)|^2 \tag{15}$$

To obtain the SNR, the ratio between the signal power and the noise power N(k) is computed, i.e., $$\mathrm{SNR}=S(k,n)/N(k).$$

As S(k,n) already contains noise, a more accurate SNR estimator in case of low SNR is given by $$\mathrm{SNR}=(S(k,n)-N(k))/N(k). \tag{16}$$

The noise power signal N(k) is assumed to be constant along time n. It can be determined for each k from the acoustic input. In fact, it is equal to the mean power of the acoustic input signal in case no sound is present, i.e., during silence. Expressed in mathematical terms, $$N(k)=\langle|x(k,n)|^2\rangle_n,\ x(k,n)\ \text{measured during silence}. \tag{17}$$

In other words, according to some embodiments of the present invention a signal characteristics determiner is configured to measure a noise signal during a silent phase of the acoustic input signal 104 and to calculate a power N(k) of the noise signal. The signal characteristics determiner may be further configured to measure an active signal during a non-silent phase of the acoustic input signal 104 and to calculate a power S(k, n) of the active signal. The signal characteristics determiner may further be configured to determine the signal-to-noise ratio of the acoustic input signal 104 based on the calculated power N(k) of the noise signal and the calculated power S(k, n) of the active signal.

This scheme may also be applied to the signal characteristics determiner 808 with the difference that the signal characteristics determiner 808 determines a power S(t) of the active signal in the time domain and determines a power N(t) of the noise signal in the time domain, to obtain the actual signal to noise ratio of the acoustic input signal 104 in the time domain.

In other words, the signal characteristics determiners 608, 808 are configured to measure a noise signal during a silent phase of the acoustic input signal 104 and to calculate a power N(k) of the noise signal. The signal characteristics determiners 608, 808 are configured to measure an active signal during a non-silent phase of the acoustic input signal 104 and to calculate a power of the active signal (S(k, n)). Furthermore, the signal characteristics determiners 608, 808 are configured to determine a signal-to-noise ratio of the acoustic input signal 104 based on the calculated power N(k) of the noise signal and the calculated power S(k) of the active signal.

In the following, another embodiment of the present invention will be descried performing an applause dependent parameter estimation.

Figure 9:
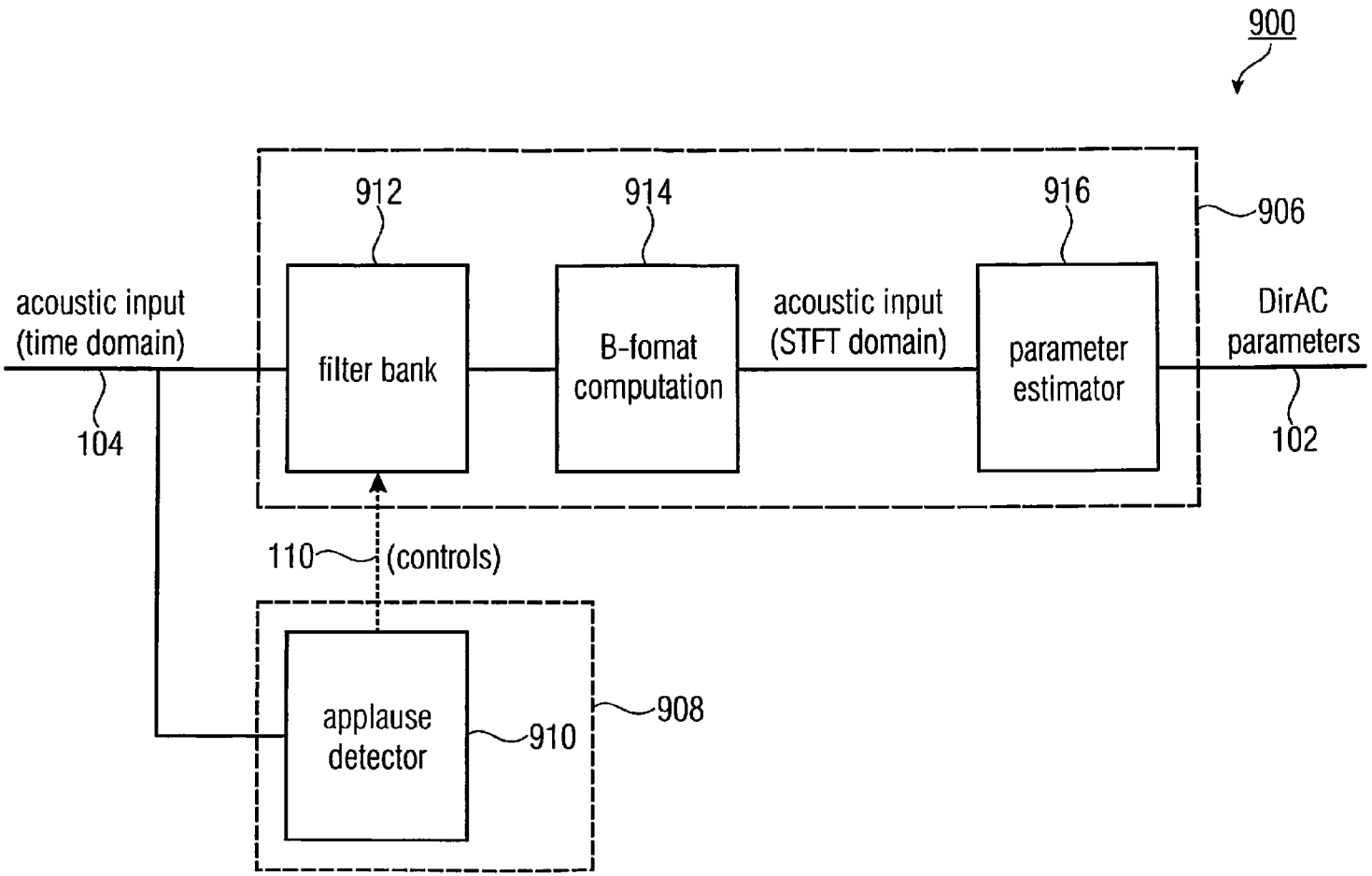
FIG. 9 shows a block schematic diagram of a spatial audio processor according to a further embodiment of the present invention.

Applause Dependent Parameter Estimation Using a Spatial Audio Processor According to FIG. 9

FIG. 9 shows a block schematic diagram of a spatial audio processor 900 according to an embodiment of the present invention. A functionality of the spatial audio processor 900 may be similar to the functionality of the spatial audio processor 100 and the spatial audio processor 900 may comprise the additional features described in the following. The spatial audio processor 900 comprises a controllable parameter estimator 906 and a signal characteristics determiner 908. A functionality of the controllable parameter estimator 906 may be similar to the functionality of the controllable parameter estimator 106 and the controllable parameter estimator 906 may comprise the additional features described in the following. A functionality of the signal characteristics determiner 908 may be similar to the functionality of the signal characteristics determiner 108 and the signal characteristics determiner 908 may comprise the additional features described in the following.

The signal characteristics determiner 908 is configured to determine if the acoustic input signal 104 comprises transient components which correspond to applause-like signals, for example using an applause detector 910.

Applause-like signals defined herein as signals, which comprise a fast temporal sequence of transients, for example, with different directions.

The controllable parameter estimator 906 comprises a filter bank 912 which is configured to convert the acoustic input signal 104 from the time domain to a frequency representation (for example to a STFT-domain) based on a conversion calculation rule. The controllable parameter estimator 906 is configured to choose the conversion calculation rule for converting the acoustic input signal 104 from the time domain to the frequency representation out of a plurality of conversion calculation rules in accordance with a result of a signal characteristics determination performed by the signal characteristics determiner 908. The result of the signal characteristics determination constitutes the determined signal characteristic 110 of the signal characteristics determiner 908. The controllable parameter estimator 906 chooses the conversion calculation rule out of a plurality of conversion calculation rules such that a first conversion calculation rule out of the plurality of conversion calculation rules is chosen for converting the acoustic input signal 104 from the time domain to the frequency representation when the acoustic input signal comprises components corresponding to applause, and such that a second conversion calculation rule out of the plurality of conversion calculation rules is chosen for converting the acoustic input signal 104 from the time domain to the frequency representation when the acoustic input signal 104 comprises no components corresponding to applause.

Or in other words, the controllable parameter estimator 906 is configured to choose an appropriate conversion calculation rule for converting the acoustic input signal 104 from the time domain to the frequency representation in dependence on an applause detection.

In short, the spatial audio processor 900 is shown as an exemplary embodiment of the invention where the parametric description of the sound field is determined depending on the characteristic of the acoustic input signals or the acoustic input signal 104. In case the microphones capture applause or the acoustic input signal 104 comprises components corresponding to applause-like signals, a special processing in order to increase the accuracy of the parameter estimation is used.

Applause is usually characterized by a fast variation of the direction of the arrival of the sound within a very short time period. Moreover, the captured sound signals mainly contain transients. It has been found that for an accurate analysis of the sound it is advantageous to have a system that can resolve the fast temporal variation of the direction of arrival and that can preserve the transient character of the signal components.

These goals can be achieved by using a filter bank with high temporal resolution (e.g. an STFT with short transform or short block length) for transforming the acoustic time domain input signals. When using such a filter bank, the spectral resolution of the system will be reduced. This is not problematic for applause signals as the DOA of the sound does not vary much along frequency due to the transient characteristics of the sound. However, it has been found that a small spectral resolution is problematic for other signals such as speech in a double talk scenario, where a certain spectral resolution is needed to be able to distinguish between the individual talkers. It has been found that an accurate parameter estimation may need a signal dependent switching of the filter bank (or of the corresponding transform or block length of the filter bank) depending on the characteristic of the acoustic input signals or of the acoustic input signal 104.

The spatial coder 900 shown in FIG. 9 represents a possible realization of performing the signal dependent switching of the filter bank 912 or of choosing the conversion calculation rule of the filter bank 912. Before transforming the acoustic input signals or the acoustic input signal 104 into the frequency representation (e.g. into the STFT domain) with the filter bank 912, the input signals or the input signal 104 is passed to the applause detector 910 of the signal characteristics determiner 908. The acoustic input signal 104 is passed to the applause detector 910 in the time domain. The applause detector 910 of the signal characteristic determiner 908 controls the filter bank 912 based on the determined signal characteristic 110 (which in this case signals if the acoustic input signal 104 contains components corresponding to applause-like signals or not). If applause is detected in the acoustic input signals or in the acoustic input signal 104, the controllable parameter estimator 900 switches to a filter bank or in other words a conversion calculation rule is chosen in the filter bank 912, which is appropriate for the analysis of applause. In case no applause is present, a conventional filter bank or in other words a conventional conversion calculation rule, which may be, for example, known from the directional audio coder 200, is used. After transforming the acoustic input signal 104 to the STFT domain (or another frequency representation), a conventional directional audio coding processing can be carried out (using a B-format computation block 914 and a parameter estimation block 916 of the controllable parameter estimator 906). In other words, the determination of the directional audio coding parameters, which constitute the spatial parameters 102, which are determined by the spatial audio processor 900, can be carried out using the B-format computation block 914 and the parameter estimation block 916 as described according to the directional audio coder 200 shown in FIG. 2. The results are, for example, the directional audio coding parameters, i.e. direction $\phi(k, n)$ and diffuseness $\Psi(k, n)$.

Or in other words the spatial audio processor 900 provides a concept in which the estimation of the directional audio coding parameters is improved by switching the filter bank in case of applause signals or applause-like signals.

In short, the controllable parameter estimator 906 is configured such that the first conversion calculation rule corresponds to a higher temporal resolution of the acoustic input signal in the frequency representation than the second conversion calculation rule, and such that the second conversion calculation rule corresponds to a higher spectral resolution of the acoustic input signal in the frequency representation than the first conversion calculation rule.

The applause detector 910 of the signal characteristics determiner 908 may, for example, determine if the signal acoustic input signal 104 comprises applause-like signals based on metadata, e.g., generated by a user.

The spatial audio processor 900 shown in FIG. 9 can also be applied to the SAM analysis in a similar way with the difference that now the filter bank of the SAM is controlled by the applause detector 910 of the signal characteristics determiner 908.

In a further embodiment of the present invention the controllable parameter estimator may determine the spatial parameters using different parameter estimation strategies independent on the determined signal characteristic, such that for each parameter estimation strategy the controllable parameters estimator determines a set of spatial parameters of the acoustic input signal. The controllable parameter estimator may be further configured to select one set of spatial parameters out of the determined sets of spatial parameters as the spatial parameter of the acoustic input signal, and therefore as the result of the estimation process in dependence on the determined signal characteristic. For example, a first variable spatial parameter calculation rule may comprise: determine spatial parameters of the acoustic input signal for each parameter estimation strategy and select the set of spatial parameters determined with a first parameter estimation strategy. A second variable spatial parameter calculation rule may comprise: determine spatial parameters of the acoustic input signal for each parameter estimation strategy and select the set of spatial parameters determined with a second parameter estimation strategy.

Figure 10:
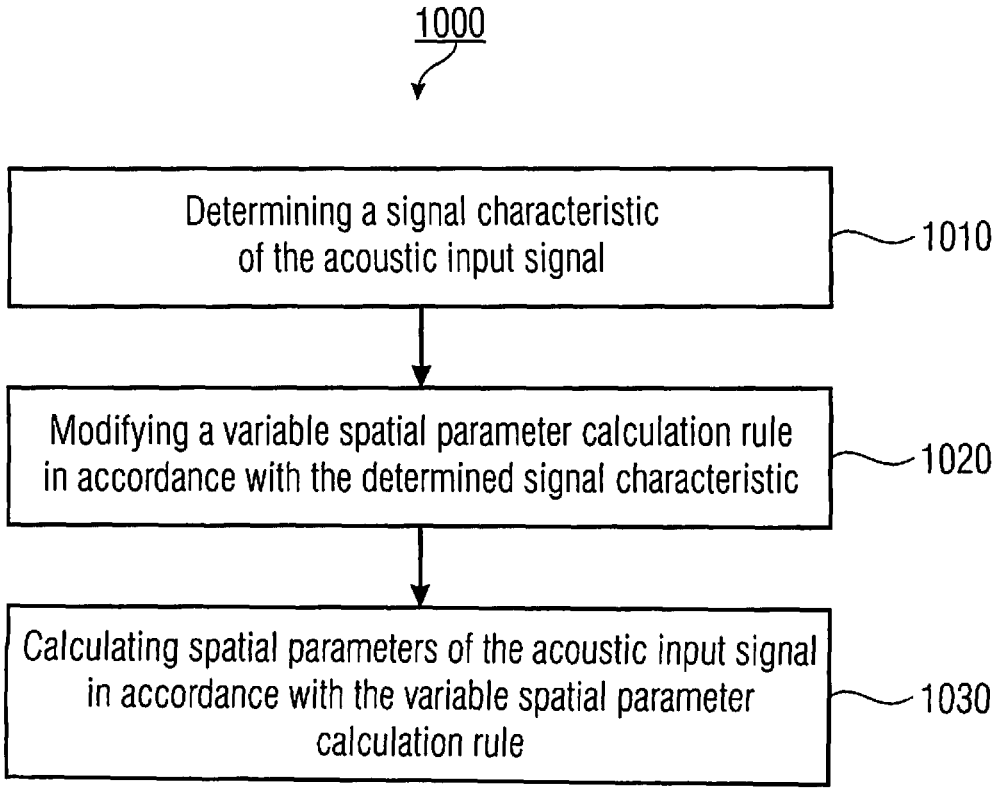
FIG. 10 shows a flow diagram of a method according to a further embodiment of the present invention.

FIG. 10 shows a flow diagram of a method 1000 according to an embodiment of the present invention.

The method 1000 for providing spatial parameters based on an acoustic input signal comprises a step 1010 of determining a signal characteristic of the acoustic input signal.

The method 1000 further comprises a step 1020 of modifying a variable spatial parameter calculation rule in accordance with the determined signal characteristic.

The method 1000 further comprises a step 1030 of calculating spatial parameters of the acoustic input signal in accordance with the variable spatial parameter calculation rule.

Embodiments of the present invention relate to a method that controls parameter estimation strategies in systems for spatial sound representation based on characteristics of acoustic input signals, i.e. microphone signals.

In the following some aspects of embodiments of the present invention will be summarized.

At least some embodiments of the present invention are configured for receiving acoustic multi-channel audio signals, i.e. microphone signals. From the acoustic input signals, embodiments of the present invention can determine the specific signal characteristics. On the basis of the signal characteristics embodiments of the present invention may choose the best fitting signal model. The signal model may then control the parameter estimation strategy. Based on the controlled or selected parameter estimation strategy embodiments of the present invention can estimate best fitting spatial parameters for the given the acoustic input signal.

The estimation of parametric sound field descriptions relies on specific assumptions on the acoustic input signals. However, this input can exhibit a significant temporal variance and thus a general time invariant model is often inadequate. In parametric coding this problem can be solved by a priori identifying the signal characteristics and then choosing the best coding strategy in a time variant manner. Embodiments of the present invention determine the signal characteristics of the acoustic input signals not a priori but continuously, for example blockwise, for example for a frequency subband and a time slot or for a subset of frequency subbands and/or a subset of time slots. Embodiments of the present invention may apply this strategy to acoustic front-ends for parametric spatial audio processing and/or spatial audio coding such as directional audio coding (DirAC) or spatial audio microphone (SAM).

It is an idea of embodiments of the present invention to use time variant signal dependent data processing strategies for the parameter estimation in parametric spatial audio coding based on microphone signals or other acoustic input signals.

Embodiments of the present invention have been described with a main focus on the parameter estimation in directional audio coding, however the presented concept can also be applied to other parametric approaches, such as spatial audio microphone.

Embodiments of the present invention provide a signal adaptive parameter estimation for spatial sound based on acoustic input signals.

Different embodiments of the present invention have been described. Some embodiments of the present invention perform a parameter estimation depending on a stationarity interval of the input signals. Further embodiments of the present invention perform a parameter estimation depending on double talk situations. Further embodiments of the present invention perform a parameter estimation depending on a signal-to-noise ratio of the input signals. Further embodiments of the preset invention perform a parameter estimation based on the averaging of the sound intensity vector depending on the input signal-to-noise ratio. Further embodiments of the present invention perform the parameter estimation based on an averaging of the estimated direction parameter depending on the input signal-to-noise ratio. Further embodiments of the present invention perform the parameter estimation by choosing an appropriate filter bank or an appropriate conversion calculation rule depending on the input signal-to-noise ratio. Further embodiments of the present invention perform the parameter estimation depending on the tonality of the acoustic input signals. Further embodiments of the present invention perform the parameter estimation depending on applause like signals.

A spatial audio processor may be, in general, an apparatus which processes spatial audio and generates or processes parametric information.

Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A spatial audio processor for providing spatial parameters based on an acoustic input signal, the spatial audio processor comprising:

a signal characteristics determiner configured to determine a signal characteristic of the acoustic input signal, wherein the acoustic input signal comprises at least one directional component; and a controllable parameter estimator for calculating the spatial parameters for the acoustic input signal in accordance with a variable spatial parameter calculation rule;

wherein the controllable parameter estimator is configured to modify the variable spatial parameter calculation rule in accordance with the determined signal characteristic;

wherein the signal characteristics determiner is configured to determine a stationarity interval of the acoustic input signal; and wherein the controllable parameter estimator is configured to modify the variable spatial parameter calculation rule in accordance with the determined stationarity interval, so that an averaging period for calculating the spatial parameters is comparatively longer for a comparatively longer stationarity interval and is comparatively shorter for a comparatively shorter stationarity interval.

2. The spatial audio processor according to claim 1, wherein the spatial parameters comprise a direction of the sound, and/or a diffuseness of the sound, and/or a statistical measure of the direction of the sound.

3. The spatial audio processor according to claim 1, wherein the controllable parameter estimator is configured to calculate the spatial parameters as directional audio coding parameters comprising a diffuseness parameter for a time slot and for a frequency subband and/or a direction of arrival parameter for a time slot and for a frequency subband or as spatial audio microphone parameters.

4. The spatial audio processor according to claim 1, wherein the controllable parameter estimator is configured to calculate the spatial parameters from the acoustic input signal for a time slot and a frequency subband based on at least one time averaging of signal parameters of the acoustic input signal; and wherein the controllable parameter estimator is configured to vary an averaging period of the time averaging of the signal parameters of the acoustic input signal in accordance with the determined stationarity interval.

5. The spatial audio processor according to claim 4, wherein the controllable parameter estimator is configured to apply the time averaging of the signal parameters of the acoustic input signal using a low pass filter;

wherein the controllable parameter estimator is configured to adjust a weighting between a current signal parameter of the acoustic input signal and previous signal parameters of the acoustic input signal based on a weighting parameter, such that the averaging period is based on the weighting parameter, such that a weight of the current signal parameter compared to the weight of the previous signal parameters is comparatively high for a comparatively short stationarity interval and such that the weight of the current signal parameter compared to the weight of the previous signal parameters is comparatively low for a comparatively long stationarity interval.

6. A spatial audio processor for providing spatial parameters based on an acoustic input signal, the spatial audio processor comprising:

a signal characteristics determiner configured to determine a signal characteristic of the acoustic input signal, wherein the acoustic input signal comprises at least one directional component; and a controllable parameter estimator for calculating the spatial parameters for the acoustic input signal in accordance with a variable spatial parameter calculation rule;

wherein the controllable parameter estimator is configured to modify the variable spatial parameter calculation rule in accordance with the determined signal characteristic;

wherein the controllable parameter estimator is configured to select one spatial parameter calculation rule out of a plurality of spatial parameter calculation rules for calculating the spatial parameters, in dependence on the determined signal characteristic;

wherein the controllable parameter estimator is configured such that a first spatial parameter calculation rule out of the plurality of spatial parameter calculation rules is different to a second spatial parameter calculation rule out of the plurality of spatial parameter calculation rules and wherein the first spatial parameter calculation rule and the second spatial parameter rule are selected from a group comprising: time averaging over a plurality of time slots in a frequency subband, frequency averaging over a plurality of frequency subbands in a time slot, time averaging and frequency averaging and no averaging.

7. A spatial audio processor for providing spatial parameters based on an acoustic input signal, the spatial audio processor comprising:

a signal characteristics determiner configured to determine a signal characteristic of the acoustic input signal, wherein the acoustic input signal comprises at least one directional component; and a controllable parameter estimator for calculating the spatial parameters for the acoustic input signal in accordance with a variable spatial parameter calculation rule;

wherein the controllable parameter estimator is configured to modify the variable spatial parameter calculation rule in accordance with the determined signal characteristic;

wherein the signal characteristics determiner is configured to determine if the acoustic input signal comprises components from different sound sources at the same time or wherein the signal characteristics determiner is configured to determine a tonality of the acoustic input signal;

wherein the controllable parameter estimator is configured to select in accordance with a result of the signal characteristics determination a spatial parameter calculation rule out of a plurality of spatial parameter calculation rules, for calculating the spatial parameters, such that a first spatial parameter calculation rule out of the plurality of spatial parameter calculation rules is chosen when the acoustic input signal comprises components of at maximum one sound source or when the tonality of the acoustic input signal is below a given tonality threshold level and such that a second spatial parameter calculation rule out of the plurality of spatial parameter calculation rules is chosen when the acoustic input signal comprises components of more than one sound source at the same time or when the tonality of the acoustic input signal is above a given tonality threshold level;

wherein the first spatial parameter calculation rule comprises a frequency averaging over a first number of frequency subbands and the second spatial parameter calculation rule comprises a frequency averaging over a second number of frequency subbands or does not comprise a frequency averaging; and wherein the first number is larger than the second number.

8. A spatial audio processor for providing spatial parameters based on an acoustic input signal, the spatial audio processor comprising:

a signal characteristics determiner configured to determine a signal characteristic of the acoustic input signal, wherein the acoustic input signal comprises at least one directional component; and a controllable parameter estimator for calculating the spatial parameters for the acoustic input signal in accordance with a variable spatial parameter calculation rule;

wherein the controllable parameter estimator is configured to modify the variable spatial parameter calculation rule in accordance with the determined signal characteristic;

wherein the signal characteristics determiner is configured to determine a signal-to-noise ratio of the acoustic input signal;

wherein the controllable parameter estimator is configured to apply a time averaging over a plurality of time slots in a frequency subband, a frequency averaging over a plurality of frequency subbands in a time slot, a spatial averaging or a combination thereof; and wherein the controllable parameter estimator is configured to vary an averaging period of the time averaging, of the frequency averaging, of the spatial averaging, or of the combination thereof in accordance with the determined signal-to-noise ratio, such that the averaging period is comparatively longer for a comparatively lower signal-to-noise ratio of the acoustic input signal and such that the averaging period is comparatively shorter for a comparatively higher signal-to-noise ratio of the acoustic input signal.

9. The spatial audio processor according to claim 8, wherein the controllable parameter estimator is configured to apply the time averaging to a subset of intensity parameters over a plurality of time slots and a frequency subband or to a subset of direction of arrival parameters over a plurality of time slots and a frequency subband; and wherein a number of intensity parameters in the subset of intensity parameters or a number of direction of arrival parameters in the subset of direction of arrival parameters corresponds to the averaging period of the time averaging, such that the number of intensity parameters in the subset of intensity parameters or the number of direction of arrival parameters in the subset of direction of arrival parameters is comparatively lower for a comparatively higher signal-to-noise ratio of the acoustic input signal and such that the number of intensity parameters in the subset of intensity parameters or the number of direction of arrival parameters in the subset of direction of arrival parameters is comparatively higher for a comparatively lower signal-to-noise ratio of the acoustic input signal.

10. The spatial audio processor according to claim 8, wherein the signal characteristics determiner is configured to provide the signal-to-noise ratio of the acoustic input signal as a plurality of signal-to-noise ratio parameters of the acoustic input signal, each signal-to-noise ratio parameter of the acoustic input signal being associated to a frequency subband and a time slot, wherein the controllable parameter estimator is configured to receive a target signal-to-noise ratio as a plurality of target signal-to-noise ratio parameters, each target signal-to-noise ratio parameter being associated to a frequency subband and a time slot; and wherein the controllable parameter estimator is configured to vary the averaging period of the time averaging in accordance with a current signal-to-noise ratio parameter of the acoustic input signal, such that a current signal-to-noise ratio parameter attempts to match a current target signal-to-noise ratio parameter.

11. A spatial audio processor for providing spatial parameters based on an acoustic input signal, the spatial audio processor comprising:

a signal characteristics determiner configured to determine a signal characteristic of the acoustic input signal, wherein the acoustic input signal comprises at least one directional component; and a controllable parameter estimator for calculating the spatial parameters for the acoustic input signal in accordance with a variable spatial parameter calculation rule;

wherein the controllable parameter estimator is configured to modify the variable spatial parameter calculation rule in accordance with the determined signal characteristic;

wherein the signal characteristics determiner is configured to determine if the acoustic input signal comprises transient components which correspond to applause-like signals;

wherein the controllable parameter estimator comprises a filter bank which is configured to convert the acoustic input signal from a time domain to a frequency representation based on a conversion calculation rule; and wherein the controllable parameter estimator is configured to choose the conversion calculation rule for converting the acoustic input signal from the time domain to the frequency representation out of a plurality of conversion calculation rules in accordance with the result of the signal characteristics determination, such that a first conversion calculation rule out of the plurality of conversion calculation rules is chosen for converting the acoustic input signal from the time domain to the frequency representation when the acoustic input signal comprises components corresponding to applause-like signals, and such that a second conversion calculation rule out of the plurality of conversion calculation rules is chosen for converting the acoustic input signal from the time domain to the frequency representation when the acoustic input signal comprises no components corresponding to applause-like signals.

12. A method for providing spatial parameters based on an acoustic input signal, the method comprising:

determining a signal characteristic of the acoustic input signal, wherein the acoustic input signal comprises at least one directional component;

modifying a variable spatial parameter calculation rule in accordance with the determined signal characteristic; and calculating spatial parameters of the acoustic input signal in accordance with the variable spatial parameter calculation rule;

wherein a stationarity interval of the acoustic input signal is determined; and wherein the variable spatial parameter calculation rule is modified in accordance with the determined stationarity interval, so that an averaging period for calculating the spatial parameters is comparatively longer for a comparatively longer stationarity interval and is comparatively shorter for a comparatively shorter stationarity interval.

13. A non-transitory computer-readable medium comprising a computer program comprising a program code for performing, when running on a computer, the method for providing spatial parameters based on an acoustic input signal, the method comprising:

determining a signal characteristic of the acoustic input signal, wherein the acoustic input signal comprises at least one directional component;

modifying a variable spatial parameter calculation rule in accordance with the determined signal characteristic; and calculating spatial parameters of the acoustic input signal in accordance with the variable spatial parameter calculation rule;

wherein a stationarity interval of the acoustic input signal is determined; and wherein the variable spatial parameter calculation rule is modified in accordance with the determined stationarity interval, so that an averaging period for calculating the spatial parameters is comparatively longer for a comparatively longer stationarity interval and is comparatively shorter for a comparatively shorter stationarity interval.

14. A spatial audio processor for providing spatial parameters based on an acoustic input signal, the spatial audio processor comprising:

a signal characteristics determiner configured to determine a signal characteristic of the acoustic input signal; and a controllable parameter estimator for calculating the spatial parameters for the acoustic input signal in accordance with a variable spatial parameter calculation rule;

wherein the controllable parameter estimator is configured to modify the variable spatial parameter calculation rule in accordance with the determined signal characteristic;

wherein the signal characteristics determiner is configured to determine a stationarity interval of the acoustic input signal and the controllable parameter estimator is configured to modify the variable spatial parameter calculation rule in accordance with the determined stationarity interval, so that an averaging period for calculating the spatial parameters is comparatively longer for a comparatively longer stationarity interval and is comparatively shorter for a comparatively shorter stationarity interval; or wherein the controllable parameter estimator is configured to select one spatial parameter calculation rule out of a plurality of spatial parameter calculation rules for calculating the spatial parameters, in dependence on the determined signal characteristic.

15. A method for providing spatial parameters based on an acoustic input signal, the method comprising:

determining a signal characteristic of the acoustic input signal;

modifying a variable spatial parameter calculation rule in accordance with the determined signal characteristic;

calculating spatial parameters of the acoustic input signal in accordance with the variable spatial parameter calculation rule; and determining a stationarity interval of the acoustic input signal and modifying the variable spatial parameter calculation rule in accordance with the determined stationarity interval, so that an averaging period for calculating the spatial parameters is comparatively longer for a comparatively longer stationarity interval and is comparatively shorter for a comparatively shorter stationarity interval; or selecting one spatial parameter calculation rule out of a plurality of spatial parameter calculation rules for calculating the spatial parameters in dependence on the determined signal characteristic.

16. A non-transitory computer-readable medium comprising a computer program comprising a program code for performing, when running on a computer, the method according to claim 15.

17. The spatial audio processor according to claim 1, wherein information gathered by the signal characteristics determiner is used to control the controllable parameter estimator.

18. The spatial audio processor according to claim 1, wherein the information gathered by the signal characteristics determiner is used to select an estimator strategy which best fits a current signal characteristic of the acoustic input signal.

19. The spatial audio processor according to claim 1, wherein the signal characteristics comprise at least one out of: stationarity intervals with respect to time or with respect to frequency or with respect to space, presence of double talk or multiple sound sources, presence of tonality or transients, signal-to-noise ratio of the acoustic input signal, presence of applause-like signals.

20. The spatial audio processor according to claim 1, wherein the spatial audio processor is configured to identify a signal model which best fits the current signal characteristics.

21. A method for providing spatial parameters based on an acoustic input signal, the method comprising:

determining a signal characteristic of the acoustic input signal, wherein the acoustic input signal comprises at least one directional component;

modifying a variable spatial parameter calculation rule in accordance with the determined signal characteristic; and calculating spatial parameters of the acoustic input signal in accordance with the variable spatial parameter calculation rule;

wherein one spatial parameter calculation rule is selected out of a plurality of spatial parameter calculation rules for calculating the spatial parameters, in dependence on the determined signal characteristic; and wherein a first spatial parameter calculation rule out of the plurality of spatial parameter calculation rules is different to a second spatial parameter calculation rule out of the plurality of spatial parameter calculation rules and wherein the first spatial parameter calculation rule and the second spatial parameter rule are selected from a group comprising: time averaging over a plurality of time slots in a frequency subband, frequency averaging over a plurality of frequency subbands in a time slot, time averaging and frequency averaging and no averaging.

22. A method for providing spatial parameters based on an acoustic input signal, the method comprising:

determining a signal characteristic of the acoustic input signal, wherein the acoustic input signal comprises at least one directional component;

modifying a variable spatial parameter calculation rule in accordance with the determined signal characteristic; and calculating spatial parameters of the acoustic input signal in accordance with the variable spatial parameter calculation rule;

wherein the method comprises determining if the acoustic input signal comprises components from different sound sources at the same time or determining a tonality of the acoustic input signal; and wherein the method comprises selecting in accordance with a result of the signal characteristics determination a spatial parameter calculation rule out of a plurality of spatial parameter calculation rules, for calculating the spatial parameters, such that a first spatial parameter calculation rule out of the plurality of spatial parameter calculation rules is chosen when the acoustic input signal comprises components of at maximum one sound source or when the tonality of the acoustic input signal is below a given tonality threshold level and such that a second spatial parameter calculation rule out of the plurality of spatial parameter calculation rules is chosen when the acoustic input signal comprises components of more than one sound source at the same time or when the tonality of the acoustic input signal is above a given tonality threshold level;

wherein the first spatial parameter calculation rule comprises a frequency averaging over a first number of frequency subbands and the second spatial parameter calculation rule comprises a frequency averaging over a second number of frequency subbands or does not comprise a frequency averaging; and wherein the first number is larger than the second number.

23. A method for providing spatial parameters based on an acoustic input signal, the method comprising:

determining a signal characteristic of the acoustic input signal, wherein the acoustic input signal comprises at least one directional component;

modifying a variable spatial parameter calculation rule in accordance with the determined signal characteristic; and calculating spatial parameters of the acoustic input signal in accordance with the variable spatial parameter calculation rule;

wherein a signal-to-noise ratio of the acoustic input signal is determined;

wherein a time averaging over a plurality of time slots in a frequency subband, a frequency averaging over a plurality of frequency subbands in a time slot, a spatial averaging or a combination thereof is applied; and wherein an averaging period of the time averaging, of the frequency averaging, of the spatial averaging, or of the combination thereof is varied in accordance with the determined signal-to-noise ratio, such that the averaging period is comparatively longer for a comparatively lower signal-to-noise ratio of the acoustic input signal and such that the averaging period is comparatively shorter for a comparatively higher signal-to-noise ratio of the acoustic input signal.

24. A method for providing spatial parameters based on an acoustic input signal, the method comprising:

determining a signal characteristic of the acoustic input signal, wherein the acoustic input signal comprises at least one directional component;

modifying a variable spatial parameter calculation rule in accordance with the determined signal characteristic; and calculating spatial parameters of the acoustic input signal in accordance with the variable spatial parameter calculation rule;

wherein the method comprises determining if the acoustic input signal comprises transient components which correspond to applause-like signals;

wherein the acoustic input signal is converted from a time domain to a frequency representation based on a conversion calculation rule; and wherein the conversion calculation rule for converting the acoustic input signal from the time domain to the frequency representation is chosen out of a plurality of conversion calculation rules in accordance with the result of the signal characteristics determination, such that a first conversion calculation rule out of the plurality of conversion calculation rules is chosen for converting the acoustic input signal from the time domain to the frequency representation when the acoustic input signal comprises components corresponding to applause-like signals, and such that a second conversion calculation rule out of the plurality of conversion calculation rules is chosen for converting the acoustic input signal from the time domain to the frequency representation when the acoustic input signal comprises no components corresponding to applause-like signals.

25. A non-transitory computer-readable medium comprising a computer program comprising a program code for performing, when running on a computer, the method according to claim 21.

26. A non-transitory computer-readable medium comprising a computer program comprising a program code for performing, when running on a computer, the method according to claim 22.

27. A non-transitory computer-readable medium comprising a computer program comprising a program code for performing, when running on a computer, the method according to claim 23.

28. A non-transitory computer-readable medium comprising a computer program comprising a program code for performing, when running on a computer, the method according to claim 24.

* * * * *